US009176409B2

(12) United States Patent
Ishii et al.

(10) Patent No.: US 9,176,409 B2
(45) Date of Patent: Nov. 3, 2015

(54) TONER, DEVELOPMENT AGENT, TONER CONTAINER, AND IMAGE FORMING APPARATUS

(71) Applicants: Masayuki Ishii, Shizuoka (JP); Toyoshi Sawada, Kanagawa (JP)

(72) Inventors: Masayuki Ishii, Shizuoka (JP); Toyoshi Sawada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/047,255

(22) Filed: Oct. 7, 2013

(65) Prior Publication Data

US 2014/0113226 A1 Apr. 24, 2014

(30) Foreign Application Priority Data

Oct. 24, 2012 (JP) ..... 2012-235027

(51) Int. Cl.
*G03G 9/00* (2006.01)
*G03G 9/13* (2006.01)
*G03G 9/093* (2006.01)

(52) U.S. Cl.
CPC ..... *G03G 9/09321* (2013.01); *G03G 9/09342* (2013.01); *G03G 9/09371* (2013.01)

(58) Field of Classification Search
CPC ..... G03G 9/00; G03G 15/08
USPC ..... 430/123.51, 105; 399/252
See application file for complete search history.

(56) References Cited

U.S. PATENT DOCUMENTS

| | | | | |
|---|---|---|---|---|
| 6,246,848 | B1 * | 6/2001 | Morinaga et al. | 399/106 |
| 2002/0037467 | A1 | 3/2002 | Watanabe et al. | |
| 2002/0132177 | A1 | 9/2002 | Sawada et al. | |
| 2002/0136975 | A1 | 9/2002 | Shiraishi et al. | |
| 2003/0077534 | A1 | 4/2003 | Shiraishi et al. | |
| 2003/0096183 | A1 | 5/2003 | Katoh et al. | |
| 2003/0129518 | A1 | 7/2003 | Sawada et al. | |
| 2003/0219670 | A1 | 11/2003 | Sawada et al. | |
| 2004/0157147 | A1 | 8/2004 | Shiraishi et al. | |
| 2004/0234879 | A1 | 11/2004 | Hasegawa et al. | |
| 2005/0008962 | A1 | 1/2005 | Katoh et al. | |
| 2005/0214670 | A1 | 9/2005 | Matsumoto et al. | |
| 2005/0250037 | A1 | 11/2005 | Sawada et al. | |
| 2005/0277046 | A1 | 12/2005 | Sawada et al. | |
| 2006/0063081 | A1 | 3/2006 | Nagatomo et al. | |
| 2006/0204883 | A1 | 9/2006 | Nakayama et al. | |
| 2006/0240351 | A1 | 10/2006 | Sugiura et al. | |
| 2007/0031748 | A1 | 2/2007 | Kotsugai et al. | |
| 2007/0059628 | A1 | 3/2007 | Tanaka et al. | |
| 2007/0218383 | A1 | 9/2007 | Seshita et al. | |
| 2007/0275315 | A1 | 11/2007 | Nagatomo et al. | |
| 2008/0014527 | A1 | 1/2008 | Kotsugai et al. | |
| 2008/0076055 | A1 | 3/2008 | Sawada et al. | |
| 2008/0226998 | A1 | 9/2008 | Ishii et al. | |
| 2008/0227017 | A1 * | 9/2008 | Nakamura et al. | 430/110.3 |
| 2008/0254378 | A1 | 10/2008 | Matsumoto et al. | |
| 2008/0268366 | A1 | 10/2008 | Nakayama et al. | |
| 2008/0292361 | A1 | 11/2008 | Seshita et al. | |
| 2009/0074467 | A1 | 3/2009 | Seshita et al. | |
| 2009/0142094 | A1 | 6/2009 | Sawada et al. | |
| 2010/0104965 | A1 | 4/2010 | Inoue et al. | |
| 2010/0119255 | A1 | 5/2010 | Seshita et al. | |
| 2010/0209147 | A1 * | 8/2010 | Kubo et al. | 399/270 |
| 2010/0216068 | A1 | 8/2010 | Kotsugai et al. | |
| 2011/0129775 | A1 | 6/2011 | Sawada et al. | |
| 2011/0136051 | A1 | 6/2011 | Ishii et al. | |
| 2012/0058425 | A1 * | 3/2012 | Shu | 430/105 |
| 2013/0101934 | A1 * | 4/2013 | Chiba et al. | 430/108.7 |
| 2013/0164665 | A1 | 6/2013 | Ishii et al. | |

FOREIGN PATENT DOCUMENTS

| | | |
|---|---|---|
| JP | 2001-066820 | 3/2001 |
| JP | 2007-156099 | 6/2007 |
| JP | 2007-248911 | 9/2007 |

* cited by examiner

*Primary Examiner* — Thorl Chea
(74) *Attorney, Agent, or Firm* — Oblon, McClelland, Maier & Neustadt, L.L.P.

(57) ABSTRACT

Toner contains a mother toner particle containing a binder resin and a coloring agent and an external additive to cover the mother toner particle, wherein the external additive contains a resin particle, wherein the resin particle has an outer shell layer formed of silica or modified silica, wherein the resin particle has a non-spherical form with a shape factor (SF) of 1.20 or greater as calculated by the following relationship 1, Shape factor(SF)=[(Absolute maximum length of particle)$^2$/Projected area of particle)]×(π/4) Relation 1.

6 Claims, No Drawings

TONER, DEVELOPMENT AGENT, TONER CONTAINER, AND IMAGE FORMING APPARATUS

CROSS-REFERENCE TO RELATED APPLICATIONS

This patent application is based on and claims priority pursuant to 35 U.S.C. §119 to Japanese Patent Application No. 2012-235027, filed on Oct. 24, 2012, in the Japan Patent Office, the entire disclosure of which is hereby incorporated by reference herein.

BACKGROUND

1. Technical Field

The present invention is related to toner and a development agent, a toner container, an image forming apparatus, and an image forming method that use the toner.

2. Background Art

Typically, toner for developing latent electrostatic images contains external additives of particulates having an average primary particle diameter of from several nm to several tens nm. For example, hydrophobized silica particulates are used to impart chargeability, fluidity, and hydrophobicity to toner. To sustain chargeability and suppress the variation of charge size in a high temperature and humidity environment, hydrophobized titanium oxide, etc. is used in general. Recently, particles having a large particle diameter such as large silica have begun to be in use as external additives.

By adding such hydrophopbized silica or metal oxides to toner as external additives, the toner can demonstrate fluidity, chargeability, environment stability, etc., which just mother toner particles cannot secure.

Also, as technologies to cover toner particles with external additives, for example, JP-2001-066820-A discloses a particular mono-dispersed spherical silica having a true specific gravity of from 1.3 to 1.9 and a volume average particle diameter of from 80 nm to 300 nm as an external additive to toner.

According to JP-2001-066820-A mentioned above, this particular silica secures fluidity, chargeability, developability, transferability, and fixability of toner at the same time for a long period of time.

In addition, JP-2007-248911-A discloses toner that contains coloring agent particles, external additives, and organic particles having fine pores on its surface which has, for example, a cross-linking density of from 3% by weight to 15% by weight, a total volume of the fine pores of from 0.01 cc/g to 0.50 cc/g, a specific surface area of from 5 $m^2/g$ to 50 $m^2/g$, and an average pore diameter of the fine pores of from 0.01 μm to 2.0 μm.

According to JP-2007-248911-A mentioned above, toner is provided which can prolong the working life of an image forming apparatus and a development agent in addition to suppressing the degradation of images and also, a development agent, an image forming method, and a process cartridge that use the toner are provided.

In addition, JP-4668778-B1 (JP-2007-156099-A) discloses using at least three kinds of hydrophobic fine powder having different average primary particle diameters as an external additive of toner. According to JP-4668778-B (JP-2007-156099-A) mentioned above, toner is provided which sustains good transferability and cleanability for an extended period of time, prevents occurrence of filming on an image bearing member (photoreceptor), suppresses variation of unevenness of images, and in addition, exhibits excellent stability free or little from sinkage of external additives in toner caused by stirring a development agent during usage and with no or little variation of fluidity and chargeability for an extended period of time. Also, there are provided a development agent, a toner container, a process cartridge, and an image forming method that use the toner.

Although methods or technologies including covering the surface of toner particles with surface-treated particulates are successful to some degree, these need further improvement.

For example, problems such as sinkage of external additives present on the surface of mother toner particles, attachment status, prevention of degradation of properties, and detachment. should be solved.

Therefore, early provision of toner having excellent cleanability, image quality, and durability by covering the surface of the toner efficiently with a small amount of additives is in demand. Also, a development agent and an image forming method that use the toner are also in demand.

SUMMARY

The present invention provides improved toner containing a mother toner particle containing a binder resin and a coloring agent and an external additive to cover the mother toner particle, wherein the external additive contains a resin particle, wherein the resin particle has an outer shell layer formed of silica or modified silica, wherein the resin particle has a non-spherical form with a shape factor (SF) of 1.20 or greater as calculated by the following relationship 1, $$\text{Shape factor(SF)}=[(\text{Absolute maximum length of particle})^2/\text{Projected area of particle})]\times(\pi/4) \quad \text{Relation 1}$$

DETAILED DESCRIPTION

Conventionally, surface-reforming methods including attaching particulates to the surface of mother toner particles have been employed to impart demanded properties.

However, this kind of reforming by external additives has disadvantages such that attached particles are easily detached from mother toner particles or sunk therein due to external stresses. Therefore, the surface properties of the toner particles changes, which leads to change of the properties of toner, thereby degrading the high temperature stability and the fixability and changing the charging size, the fluidity, and the agglomeration degree of the toner. As a consequence, the image quality tends to deteriorate, for example, transfer of images becomes poor and back ground fouling occurs.

In view of the foregoing, the present invention is to provide toner in which external additives are attached to the surface of mother toner particles containing a binder resin and a coloring agent. The toner has durability to external stress so that the external additive attached to the surface of the mother toner particles is prevented from detachment, transfer, or sinkage.

As a result, the toner has excellent high temperature stability and fixability, thereby suppressing property changes of, for example, charging size, fluidity, and agglomeration level and reducing the degradation of the image quality.

The toner of the present disclosure contains: a mother toner particle containing a binder resin and a coloring agent; and an external additive to cover the mother toner particle, wherein the external additive contains a resin particle having an outer shell layer and a non-spherical form having a shape factor (SF) of 1.20 or greater as calculated by the following rela tionship 1, wherein the outer shell layer is formed of silica or modified silica.

$$\text{Shape factor(SF)}=[(\text{Absolute maximum length of particle})^2/\text{Projected area of particle})]\times(\pi/4) \quad \text{Relation 1}$$

In the toner of the present disclosure, the non-spherical resin particles having an outer shell layer formed of silica or modified silica used as an external additive is a so-called irregular form particle. Therefore, unlike spherical external additive such as typical spherical silica, the external additive never or little moves or detaches from the surface of the mother toner particle or sinks therein. For this reason, the effect of covering the surface of mother toner particles with the external additive never or little deteriorates so that the covering is sustained for a long period of time. This contributes to amelioration of the durability, environmental property, hydrophobicity, etc. of the toner.

The non-spherical resin particle preferably has a shape factor (SF) of 1.20 or greater as calculated by the relation 1 described above. That is, when the SF of a resin particle is within a range of from 1.00 to less than 1.20, the covering of the surface of a mother toner particle tends to be insufficient. As a result, the external additive easily moves or detaches from the surface of the mother toner particle or sinks therein.

The resin particle does not necessarily have a non-spherical form before attaching the resin particle to the surface of mother toner particle (hereinafter also referred to as toner particle surface or toner surface), meaning that it is not undesirable to make the form of resin particle having an outer shell layer formed of silica or modified silica non-spherical (form irregularizing, non-spherical forming) in the external additive addition. That is, any non-spherical (SF is 1.20 or greater) resin particle having a cover layer formed of silica or modified silica on its surface demonstrates the features required for the issues described above.

The thing is that the resin particle has an irregular form with its surface formed of a layer formed of silica or modified silica when the resin particle is present on the surface of a mother toner particle.

Since the resin particle has an irregular form, the contact surface thereof with the toner particle surface is large in comparison with a spherical resin particle. As a result, it is possible to prevent detachment, move, or sinkage of the resin particle caused by external address. Therefore, the properties of toner (such as physical properties, high temperature stability, fixability, charging size, fluidity, agglomeration level) are sustained for a long period of time and consequently the toner can keep exhibiting suitable features.

In addition, since the surface of the resin particle is covered with a layer formed of silica or modified silica, slippage and friction resistance at the contact portion are reduced in the image forming. As a result, fluidity and low agglomeration level are secured.

There are many attempts to use silica having an irregular form as an external additive. However, because of such a physical form, the irregularized silica degrades the fluidity of toner or increases the agglomeration level. For this reason, it is extremely difficult to use such silica and add a large amount thereof to toner as an external additive.

By contrast, the external additive of the present disclosure has a silica layer on the surface of a non-spherical resin particle. As a result, minor roughness on the surface of the silica layer imparts fluidity, which makes a contrast to typical silica having a high friction resistance ascribable to the uniformity of the silica surface.

Next, embodiments of the present disclosure are described.

The toner of the present disclosure contains a mother toner particle having a binder resin and a coloring agent and an external additive to cover the mother toner particle.

Resin Particle

As the resin particle having a surface on which an outer shell layer formed of a silica layer of a modified silica layer is directly formed, any particle manufacturted by a pulverization method, a polymerization method, or a supercritical method and thereafter irregularized or any particle that becomes non-spherical by a force applied during attachment to toner can be suitably used. Such resin particles achieve the features to solve the issues of the present disclosure.

Specific examples of the super critical method includes, but are not limited to, Rapid Expansion of Supercritical Fluid Solutions (RESS method), Gas Anti-Solvent (GAS method), and new Freeze Granulation by Supercritical Fluid (FG-SCF) that can form agglomeration elements of porous particulates.

There is no specific limit to the resin that constitutes the resin particle. Specific examples thereof include, but are not limited to, non-cross-linked acrylic resins (hereinafter referred to as acrylic resins), cross-linked acrylic resins, non-cross-linked polyethylene resins, and cross-linked polystyrene resins.

The resin particle preferably has a primary particle diameter of from 25 nm to 200 nm. When the particle diameter is too small, forming a covering layer tends to be difficult and in addition, deforming particles tends to be difficult, thereby making it difficult to attach the irregularized particulate to toner. When the particle diameter is too large, the toner particle easily damages the surface of an image bearing member.

The external additive contains at least non-spherical resin particles (having an outer shell layer formed of silica or modified silica) and can be used in combination with typical external additives.

Such a combinational use with typical external additives ameliorate the fluidity, the developability, and the chargeability of toner so that the toner can exhibit its features greatly. Specific examples of such optional external additives are deferred.

Outer Shell Layer

It is preferable to form the outer shell layer formed of silica or modified silica by conducting reaction of a silane derivative on the surface of the resin particle.

Preferred specific examples of the silane derivative mentioned above include, but are not limited to, reactive silicon compounds selected from substituted or non-substituted alkoxy silane compounds, substituted or non-substituted halogenized silane compounds (e.g., chlorosilane compounds), and silicates.

To form the outer shell layer formed of silica or modified silica, it is suitable to conduct reaction of silane derivatives (reactive silicon compound) on the surface of the resin particle.

Specific examples of such reactive silicon compounds include, but are not limited to, tetraalkoxy silane compounds such as tetramethoxy silane, tetraethoxy silane, tetrapropoxy silane, and tetrabuthoxy silane; alkyl alkoxy silane compounds such as monomethyl trimethoxy silane, dimethyl dimethoxy silane, trimethyl monomethoxy silane, monoethyl trimethoxy silane, diethyl dimethoxy silane, and triethyl monomomethoxy silane; phenyl alkoxy silane compounds suchas phenyl trimethoxy silane, diphenyl dimethoxy silane, and triphenyl monomethoxy silane; amino group containing silane compounds such as aminopropyl trimethoxy silane, (aminoethyl) aminopropyl dimethoxy silane, aminopropyl triethoxy silane, aminopropyl dimethyl ethoxy silane, aminopropyl methyl diethoxy silane, and aminobutyl triethoxy silane; vinyl group containing silane compounds such as vinyl trimethoxy silane and vinyl triethoxy; glycidyl group containing silane compounds such as 3-glycidoxy propyl methyl ethoxy silane and 3-glycidoxy propyl triethoxy silane; (meth)acrylic group containing silane compounds such as 3-methacryloxy propyl methyl dimethoxy silane, 3-methacryloxy propyl trimethoxy silane, 3-methacryloxy propyl methoy diethoxy silane, 3-methacryloxy propyl triethoxy silane, and 3-acryloxy propyl trimethoxy silane; chlorosilane compounds such as monochloro silane, dichloro silane, and trichloro silane; and siilcates such as sodium silicate and potassium silicate. These reactive silicon compounds can be used alone or in combination.

Tetraalkoxy silane compounds such as tetramethoxy silane, tetraethoxy silane, tetrapropoxy silane, and tetrabutoxy silane are preferable in particular.

The outer shell layer formed by conducting reaction of the silane derivative (reactive silicon compound) on the surface of a resin particle is obtained by, for example; dispersing resin particles having a content ratio of around 0.1% by weight to around 30% by weight in water or a mixture of water and an organic solvent; adding a reactive silicon compound thereto at temperatures from around 0° C. to around 50° C. followed by reaction at the same temperature for 1 hour to 48 hours; and raising the temperature to around 60° C. to around 80° C. to age the resultant for about 1 hour to about 20 hours.

During the reaction, it is possible to use a catalyst. Specific examples thereof include, but are not limited to, strong acids such as sulfuric acid and toluene sulphonic acid; halogenized metals such as titanium tetrachloride, hafnium chloride, zirconium chloride, aluminum chloride, gallium chloride, indium chloride, iron chloride, tin chloride, and boron fluoride; hydroxyl compounds, alcoholates, or carbonates of sodium hydroxide, potassium hydroxide, sodium methylate, and sodium carbonate; metal oxides such as aluminum oxide, calcium oxide, barium oxide, and sodium oxide; and organic metal compounds such as tetraisopropyl titanate, dibutyl tin dichloride, dibutyl tin oxide.

The outer shell layer obtained by reaction of the reactive silicon compound on the surface of a resin particle (organic particulate) is a silica layer when, for example, a tetraalkoxy silane compound, a tetrachlorosilane compound, or a silicate is used, a modified silica layer when, for example, an alkyl alkoxy silane compound having an alkyl group and an alkoxy group is used, and a modified silica layer (amino group containing alkyl modified silica) when, for example, an alkyl.alkoxy silane compound having an amino group containing an alkyl group containing an amino group and an alkoxy group is used.

There is no specific limit to the content of the reactive silicon compound to the resin particle. The content of the silicon atom in the reactive silicon compound is preferably from 0.5 parts by weight to 30 parts by weight, more preferably from 1 part by weight to 20 parts by weight, and furthermore preferably from 0.8 parts by weight to 10 parts by weight to 100 parts by weight of the resin particle.

When the content of the reactive silicon compound is too small, the outer shell layer may not be formed sufficiently. When the content of the reactive silicon compound is too large, cohesion or agglomeration of resin particles tends to occur.

The content of silica or modified silica forming the outer shell layer is preferably from 2% by weight to 10% by weight to the total content of the resin particle.

By adding silica or modified silica in an amount of from 2% by weight to 10% by weight to the outer shell layer, the toner surface is covered in a small amount thereof and durable to external stress, thereby sustaining good high temperature stability, fixability, and the image quality as toner particles.

The surface of the resin particle obtained by the reaction described above using the tetraalkoxy silane compound is covered with an outer shell layer formed of silica. To adjust the chargeability of toner when the resin particle is attached thereto, for example, an outer shell layer can be formed by using a reactive silicon compound such as the alkyl alkoxy silane compound specified above.

It is also possible to form an outer shell layer on the surface of a resin particle by a mixture of the tetraalkoxy silane compound and the alkyl alkoxy silane compound or form a silica layer on the surface of a resin particle first by the tetraalkoxy silane compound followed by forming an outer shell layer formed of modified silica by a reactive silicon compound such as the alkyl alkoxy silane compound specified above.

Specific examples of the reactive silicon compound (modified silicon compound) to form an outer shell layer formed of modified silica include, but are not limited to, alkyl alkoxy silane compounds such as monomethyl trimethoxy silane, dimethyl dimethoxy silane, trimethyl monomethoxy silane, monoethyl trimethoxy silane, diethyl methoxy silane, and triethyl monomethoxy silane; phenyl alkoxy silane compounds such as phenyl trimethoxy silane, diphenyl dimethoxy silane, and triphenyl monomethoxy silane; amino group containing silane compounds such as amino propyl trimethoxy silane, (aminoethyl)amino propyl dimethoxy silane, amino propyl triethoxy silane, amino propyl dimethyl ethoxy silane, amino propyl methyl diethoxy silane, and amino butyl triethoxy silane; vinyl group containing compounds such as vinyl trimethoxy silane and vinyl triethoxy silane; glycidyl group containing compounds such as 3-glycidoxy propyl methyl ethoxy silane and 3-glycidoxy propyl triethoxy silane; (meth)acrylic group containing silane compounds such as 3-methacryloxy propyl dimethoxy silane, 3-methacryloxy propyl trimethoxy silane, 3-methacryloxy propyl methyl diethoxy silane, 3-methacryloxy propyl triethoxy silane, and 3-acryloxy propyl trimethoxy silane; fluorine atom containing silane compounds such as nonafluorohexyl trimethoxy silane, nonafluorohexyl triethoxy silane, tridecafluoro hexyl trimethoxy silane, and tridecafluoro hexyl triethoxy silane; and mixtures thereof.

These modified reactive silicon compounds can be formed by mixing with a tetraalkoxy silane compound or conducting reaction to form an outer shell layer formed of modified silica after forming a silica layer.

There is no specific limit to the content of such a modified reactive silicon compound. However, if the content is excessively small, the toner cannot exhibit the feature sufficiently. If the content is excessively large, the resin particles tend to agglomerate at formation portions. Therefore, it is suitable to conduct reaction while limiting the content of silicon atoms in the modified silicon compound to preferably from 0.01 mol to 5 mol, more preferably from 0.1 mol to 3 mol, and furthermore preferably from 0.5 mol to 2 mol relative to 1 mol 1 mol of silicon atoms of the tetraalkoxy silane compound serving as the raw material that forms the silica layer.

Specifically, for example, the reaction is: adding a modified silicon compound to resin particle liquid dispersion at temperatures from 0° C. to 50° C. in which resin particles already having a silica layer are dispersed in 0.1% by weight to 30% by weight water or a liquid mixture of water and an organic solvent followed by conducting reaction at the same temperature for 1 hour to 48 hours while stirring the liquid dispersion;

and thereafter, aging the system at temperatures from 60° C. to 80° C. for 1 hour to 20 hours.

In addition, to ameliorate the fluidity, the storage, the developability, and the transferability, a conventional powder mixer can be used to admix an external additive to the surface of a resin particle but a mixer having a jacket is preferable because it can control the temperature inside the device. To change the history of the burden applied to the external additive, it is suitable to add the external additive in the midstream or little by little during mixing. It is possible to adjust the number of rotation, the rolling speed, the time, and the temperature of a mixer. Heavy burden followed by relatively light burden or vice versa is applicable. Specific examples of the mixers include, but are not limited to, V-type mixers, Rocking mixers, Lodige mixers, Nautor mixers, and Henschel mixers.

Other External Additive

The toner of the present disclosure contains at least a non-spherical resin particle having an outer shell layer formed of silica or modified silica as an external additive.

Optionally, other external additives can be added to the toner.

Specific examples thereof include, but are not limited to, aliphatic acid metal salts such as titanium oxide, silicon oxide (silica), alumina, barium titanate, magnesium titanate, calcium titanate, strontium titanate, zinc oxide, tin oxide, zinc stearate, and calcium stearate; and particulates of layered double hydroxides such as hydrotalcite.

In particular, hydrophobized inorganic particles (so-called hydrophobic inorganic particles) such as hydrophobic titanium oxide and hydrophobic silica are preferably used.

These can be used alone or in combination.

Specific examples thereof include, but are not limited to, isobutyl-hydrophobized rutile type titanium oxide and hexamethyl disilazane-hydrophobized hydrophobic silica.

Binder Resin

There is no specific limit to the binder resin contained in the mother toner particles forming the toner of the present disclosure and any known binder resin can be selected based on a particular purpose. Specific examples of the binder resins include, but are not limited to, styrene polymers and substituted styrene polymers such as polystyrene, poly-p-styrene, and polyvinyltoluene; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ether copolymers, styrene-vinyl methyl ketone copolymers, styrene-butadiene copolymers, styrene-isopropylene copolymers, and styrene-maleic acid ester copolymers; and other resins such as polymethyl methacrylate, polybutyl methacrylate, polyvinyl chloride, polyvinyl acetate, polyethylene, polyesters, epoxy resins, polyurethane resins, polyvinyl butyral resins, polyacrylic resins, rosin, modified rosins, terpene resins, phenol resins, aliphatic or aromatic hydrocarbon resins, and aromatic petroleum resins. These resins can be used alone or in combination.

In particular, polyesters are preferable among the resin materials mentioned above and urea modified polyesters are more preferable. Combinations of urea-modified polyesters and non-modified polyesters or urea-modified polyesters, non-modified polyesters, and crystalline polyesters are also preferable.

The mother toner particle can be manufactured by, for example, a pulverization method, an emulsification polymerization method, or a polymer suspension including emulsifying, suspending, and agglomerating an oil phase in an aqueous medium to form particles, a suspension polymerization method, or a polymer suspension method. That is, as the mother toner particle, materials can be used which are obtained by putting a mixture containing a toner component in a melt-kneading machine to prepare a melt-kneaded matter followed by pulverization and classification or emulsifying or dispersing a toner liquid material (oil phase) in which a toner material containing a toner component is dispersed or dissolved in an organic solvent in an aqueous medium (aqueous phase) followed by removal of the solvent.

In the present disclosure, the toner material is also referred to as toner composition.

In the case in which the solvent is removed to prepare mother toner particles after emulsifying or dispersing the toner liquid material (oil phase) in the aqueous medium (aqueous phase), for example, it is possible to conduct solvent removal after emulsifying or dispersing the toner liquid material (oil phase) in which a toner material containing at least a binder resin and/or a binder resin precursor is dissolved or dispersed in an aqueous medium (aqueous phase).

The binder resin and/or the binder resin precursor may contain a resin material containing at least one of a non-modified polyester having only ester bonding units, a modified polyester having ester bonding units and other bonding units, and a crystalline polyester. Any resin precursor that can produce the modified polyester is usable.

Non-Modified Polyester

It is possible to use a polyester that is not modified (so-called non-modified polyester) which contains no bonding units other than ester bonding units (i.e., containing only ester bonding units) as the binder resin. Such a binder resin (toner binder) component can be prepared by a combination of such a non-modified polyester, a binder resin precursor having ester bonding units, a modified polyester having ester bonding units and other bonding units or a resin precursor that can produce a modified polyester, and a crystalline polyester.

For example, a non-modified polyester and a modified polyester (for example, a urea-modified polyester) can be contained as a toner binder component.

This combinational use of the modified polyester and the non-modified polyester is more preferable to a single use of the modified polyester in terms of improvement of the low temperature fixability and the gloss property when the toner is used in a full-color image forming apparatus.

It is preferable that the non-modified polyester resin and the modified polyester resin are at least partially compatible in each other in terms of low temperature fixing property and hot offset resistance. For this reason, it is preferable that the polyester component forming the modified polyester and the component forming the non-modified polyester are similar to each other.

The peak molecular weight of the non-modified polyester is from 1,000 to 30,000, preferably from 1,500 to 10,000 and more preferably from 2,000 to 8,000. When the peak molecular weight is too small, the high temperature stability of the toner tends to deteriorate. When the peak molecular weight is too large, the low temperature fixability easily deteriorates. The weight average molecular weight of the non-modified polyester is preferably from 2,000 to 90,000 and the glass transition temperature (Tg) is preferably from 40° C. to 80° C.

The hydroxyl value of the non-modified polyester is preferably 5 or higher, more preferably from 10 to 120, and furthermore preferably from 20 to 80. A hydroxyl value that is too small is disadvantageous in terms of having a good combination of the high temperature preservability and the low temperature fixing property.

The acid value of the non-modified polyester is from 1 to 30 and preferably from 5 to 20. The non-modified polyester having an acid value tends to cause produced toner to have a negative chargeability.

In addition, when toner has an acid value and a hydroxyl value outside the range specified above, the image quality of produced images tends to be inferior in a high temperature and high humidity environment or in a low temperature and low humidity environment.

Modified Polyester Resin

The modified polyester contains at least ester bonding units and bonding units other than the ester bonding units in its molecular structure. Such a modified polyester can be prepared by reaction of a compound having an active hydrogen group and a resin precursor that has a polyester having a functional group reactive with the active hydrogen group of the compound and can produce a so-called modified polyester.

A specific example of the polyester having a functional group reactive with the active hydrogen group is a polyester prepolymer having an isocyante group or an epoxy group. Such a polyester having a functional group reactive with the active hydrogen group can be easily synthesized by reaction between a known isocyanating agent or epoxylating agent (a compound having an isocyante group or an epoxy group) and a polyester serving as a base.

A binder resin that contains a modified polyester (modified polyester having an ester bonding and a urea bonding) synthesized by elongation reaction between a polyester (polyester prepolymer) having an isocyante group and a compound having an active hydrogen group (e.g., amine) has a larger difference between the lowest fixing temperature and the hot offset occurring temperature, which leads to improvement of the releasing width.

In comparison with a known polyester based toner, the toner having a mother toner particle for use in the present disclosure tends to have a relatively good high temperature stability when a urea-modified polyester is contained as a modified polyester in the toner even if the glass transition temperature is low.

Specific examples of the isocyanating agents include, but are not limited to, aliphatic polyisocyanates, alicyclic polyisocyanates, aromatic diisosycantes, aromatic aliphatic diisocyanates, isocyanurates, blocked polyisocyanates in which the polyisocyanate mentioned above is blocked with a phenolic derivative, oxime or caprolactam, and combinations thereof. A specific example of the epoxificating agent is epichlorohydrin.

Crystalline Polyester

As described above, the binder resin having an ester bonding in the mother toner particle forming the toner of the present disclosure optionally contains a crystalline polyester.

The crystalline polyester is prepared by reaction between an alcohol component and an acid component and at least has a melting point.

There is no specific limit to the crystalline polyester. Crystalline polyesters synthesized by reaction between an alcohol component and a dicarboxylic acid. Preferred specific examples of the alcohol component includes, but are not limited to, alcohol components of saturated aliphatic diol compounds having 2 to 12 carbon atoms, in particular, 1,4-butan diol, 1,6-hexane diol, 1,8-8 octane diol, 1,10-decane diol, 1,12-dodecane diol, and derivatives thereof. Preferred specific examples of the dcarboxylic component include, but are not limited to, dicarboxylic acid components of dicarboxylic acids having carbon-carbon double bonding with 2 to 12 carbon atoms or saturated dicarboxylic acids having 2 to 12 carbon atoms, in particular, fumaric acid, 1,4-butane dacid, 1,6-hexane diacid, 1.8-octane diacid, 1,10-decane diacid, 1,12-dodecane diacid, and derivatives thereof.

By using a crystalline polyester, for example, contamination of carriers and a charging member by wax present on the surface of toner having a mother toner particle is suppressed while maintaining the releasing performance during fixing without deterioration and good results are obtained.

The content of the crystalline polyester is preferably from 1 part by weight to 100 parts by weight to 100 parts by weight of the mother toner particle. When the content is too small, the low temperature fixability easily deteriorates. When the content is too large, the image quality tends to deteriorate due to contamination on an image bearing member or other members, the fluidity of a development agent containing the toner is easily worsened, or the image density tends to become thin since the content of the crystalline polyester is present excessively on the uppermost surface of the toner. In addition, the surface form of the toner easily deteriorates and the carrier is contaminated so that the chargeability of the toner is not maintained sufficiently for a long period of time and furthermore, the environment stability is inhibited in some cases.

As describe above, the binder resin (toner binder) for the mother toner particle forming the toner of the present disclosure can be arbitrarily selected from, for example, a blended resin of the non-modified polyester and the modified polyester (polyester having ester bonding units and bonding units other than the ester bonding unit), a blended resin of the non-modified polyester and the crystalline polyester, and a blended resin of the non-modified polyester, the non-modified polyester, and the crystalline polyester. In such blending, it is preferable to consider striking a balance among hot offset resistance, high temperature stability, and low temperature fixability.

The glass transition temperature (Tg) of the binder resin (toner binder) in the present disclosure is preferably from 40° C. to 70° C. and more preferably from 40° C. to 65° C.

When the glass transition temperature is too low, the high temperature stability of the toner tends to deteriorate. When the glass transition temperature is too high, the low temperature fixability thereof tends to become undesirable.

In comparison with known polyester based toner, the toner having a mother toner particle for use in the present disclosure tends to have a relatively good high temperature stability when a urea-modified polyester is also contained as a modified polyester in the toner even if the glass transition temperature is low.

Colorant

There is no specific limit to the coloring agent used as the toner material forming the mother toner particle. Any known dye or pigment can be selected to a particular purpose. Specific examples of the coloring agents for use in the toner of the present disclosure include, but are not limited to, known dyes and pigments such as carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination.

The content of the coloring agent in the mother toner particle (colored particle) is preferably from 1% by weight to 15% by weight and more preferably from 3% by weight to 10% by weight.

The coloring agent can be used in combination with a resin as a master batch. There is no specific limit to the resins for use in the master batch and any known resin can be selected to a particular purpose.

Specific examples thereof include, but are not limited to, monopolymers of styrene or substituted styrene, styrene-based copolymers, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic hydrocarbon resins, alicyclic hydrocarbon resins, aromatic petroleum resins, chlorinated paraffin, and paraffin. These can be used alone or in combination.

Releasing agents are optionally used as the toner material forming the mother toner particle.

Releasing Agent

There is no specific limit to such releasing agents and any known releasing agent can be selected to a particular purpose. A specific example thereof is wax.

Specific examples of such wax include, but are not limited to, wax having a carbonyl group, polyolefin wax, and long-chain hydrocarbons. These can be used alone or in combination. In particular, wax having a carbonyl group is preferable.

Specific examples of the wax having a carbonyl group include, but are not limited to, polyalkane acid esters, polyalkanol esters, polyalkane acid amides, polyalkyl amides, and dialkyl ketones. In particular, polyalkane acid esters are preferable.

Specific examples of the polyalkane acid esters include, but are not limited to, carnauba wax, montan wax, trimethylol propane tribehenate, pentaerythritol tetrabehenate, pentaerythritol diacetate dibehenate, glycerin tribehenate, and 1,18-octadecanediol distearate.

Specific examples of the polyalkanol esters include, but are not limited to, trimellitic acid tristearyl and distearyl maleate.

A specific example of the polyalkane acid amide is dibehenyl amide. A specific example of the polyalkyl amide is trimellitic acid tristearyl amide.

A specific example of the dialkyl ketone is distearyl ketone.

Specific examples of the polyolefin waxes include, but are not limited to, polyethylene waxes and polypropylene waxes.

Specific examples of the long-chain hydrocarbons include, but are not limited to, paraffin wax and sazol wax.

There is no specific limit to the melting point of the releasing agent. The melting point can be set to a particular purpose and is preferably from 40° C. to 160° C. When the melting point is too low, the releasing agent tends to have an adverse impact on high temperature stability. When the melting point is too high, cold offset tends to occur during fixing at low temperatures.

The releasing agent preferably has a melt viscosity of from 5 cps to 1,000 cps and more preferably from 10 cps to 100 cps at a temperature 20° C. higher than the melting point of the releasing agent. When the melt viscosity is too low, the releasing property tends to deteriorate. When the melt viscosity is too high, the hot offset resistance and the low temperature fixability of the toner are not easily improved.

There is no specific limit to the content of the coloring agent (colored particle) in the mother toner particle and the content can be determined to a particular purpose. The content is preferably from 1% by weight to 40% by weight and more preferably from 3% by weight to 10% by weight. When the content of the releasing agent in the in the mother toner particle is too large, the fluidity of the toner tends to deteriorate.

Charge control agents, etc. are optionally used as toner materials forming a mother toner particle.

Charge Control Agent

There is no specific limit to the charge control agent and positive or negative charge control agents can be selected to a particular application depending on the plus and minus of charges applied to an image bearing member.

For example, resins or compounds having electron donating functional groups, azo dyes, or metal complexes of organic acids can be used as the negative charge control agent. Specific examples of such negative charge control agents include, but are not limited to, Bontron (product number: S-31, S-32, S-34, S-36, S-37, S-39, S-40, S44-, e-81, E-82, E-84, E-86, E-88, A, 1-A, 2-A, and 3-A, all manufactured by Orient Chemical Industries Co., Ltd.); KayaCharge (Product number: N-1 and N-2) and KayaSetBlack (product number: T-2 and 004, all manufactured by Nippon Kayaku Co., Ltd.), Aizen Spiron Black (T-37, T-77, T-95, TRH, TNS-2, all manufactured by Hodogaya Chemical Co., Ltd.); and FCA-1001-N, FCA-1001-NB, FCA-1001-NZ, all manufactured by FujikuraKasei Co., Ltd.). These can be used alone or in combination.

Specific examples of the positive charge control agents include, but are not limited to, basic compounds such as modified agents such as nigrosine dyes, cationic compounds such as quaternary ammonium salt, and metal salts of higher aliphatic acids.

Specific examples of such negative charge control agents include, but are not limited to, Bontron (product number: N-01, N-02, N-03, N-04, N-05, N-07, N-09, N-10, N-11, N-13, P-51, P-52, and AFP-B, all manufactured by Orient Chemical Industries Co., Ltd.); TP-302, TP-415, and TP-4040, all manufactured by Hodogaya Chemical Co., Ltd.); Copy Blue PR and Copy Charge (product number: PX-VP-435 and NX-VP-434, all manufactured by Hoechst Japan Co., Ltd.); FCA-(product number: 201, 201-B-1, 201-B-2, 201-B-3, 201-PB, 201-PZ, 301, all manufactured by Fujikura Kasei Co., Ltd.); and PZ (product number: 1001, 2001, 6001, and 7001, all manufactured by Shikoku Chemical Corporation). These can be used alone or in combination.

The content of the charge control agent is determined depending on the kinds of a binder resin and the manufacturing method of coloring agents including the dispersion method and therefore is not unambiguously defined. However, the content of the charge control agent is preferably from 0.05% by weight to 1.0% by weight based on the total amount of the binder resin. When the content is too large, the toner tends to have an excessively large charge size, which reduces the effect of the charge control agent, thereby increasing the electrostatic attraction force between a developing roller and the toner, which invites deterioration of the fluidity of a development agent containing the toner and a decrease of the image density of output images. When the content is too small, the charging initial rise property and the charging size of toner tend to be not sufficient, which easily has an impact on output toner images.

Method of Manufacturing Toner

As described above, the toner of the present disclosure is manufactured by covering the surface of a mother toner particle (I) obtained by a pulverization method or the surface of a mother toner particle (II) obtained by emulsifying or dispersing a toner liquid material (oil phase) in an aqueous medium (aqueous phase) with an external additive containing a non-spherical resin particles which has an outer shell layer formed of at least silica or modified silica.

The mother toner particle (I) or (II) can be suitably selected to a particular application. The mother toner particle (II) is preferably used to obtain a mother toner particle (colored particle) having a spherical form and a controlled particle size distribution.

When preparing mother toner particles (I) by a pulverization method, a mixture in which toner materials forming mother toner particles (coloring agent particles) is placed in a melt-kneading machine for melt-kneading first. A single-screw or twin-screw continuous mixing and kneading machine or a batch type mixing and kneading machine by a roll mill can be used as the melting and mixing and kneading machine. Specific examples such mixing kneader include, but are not limited to, KTK type twin-screw extruders (manufactured by KOBE STEEL., LTD.), TEM type extruders (manufactured by TOSHIBA MACHINE CO., LTD), twin-screw extruders (manufactured by KCK), PCM type twin-screw extruders (manufactured by IKEGAI CORP.), and Ko-kneaders (manufactured by Buss). It is preferable that this melt-kneading is conducted under suitable conditions not to sever the molecular chain of binder resins. To be specific, when the temperature in the melt-kneading is by far higher than the softening point, the molecular chain tends to be severely severed. When the temperature is too low, the melt-kneading tends not to proceed smoothly.

Next, the melt-kneaded mixture obtained in the melt-kneading is pulverized. In the pulverization process of the melt-kneaded mixture, it is preferable to coarsely pulverize the melt-kneaded mixture before fine pulverization. To be specific, it is preferable that the kneaded mixtures are pulverized by collision with a collision board in a jet stream, collision between particles in a jet stream, or pulverization at narrow gaps between a stator and a rotor that is mechanically in rotation.

Moreover, the pulverized matter is classified to adjust the particle diameter to be in a predetermined range. In the classification, fine particles are removed by, for example, a cyclone, a decanter, or a centrifugal. Thereafter, mother toner particles are obtained by removing coarse particles and agglomerated particle using a screen having 250 meshes or more.

To obtain the mother toner particle (II) by emulsifying or dispersing a toner liquid material (oil phase) in an aqueous medium (aqueous phase), the mother toner particle is obtained by a method including a process of preparing the toner liquid material (oil phase) by dissolving or dispersing a toner material containing a binder resin and/or a binder resin precursor, a coloring agent and an optional releasing agent and a process of emulsifying or dispersing the oil phase in the aqueous medium (aqueous phase) followed by removing the organic solvent.

It is preferable that the volume average particle diameter (Dv) of the mother toner particle is from 3.0 μm to less than 6.5 μm and the ratio (Dv/Dn) of the volume average particle diameter (Dv) to the number average particle diameter (Dn) of the mother toner particle is from 1.05 to 1.25.

When the volume average particle diameter (Dv) is excessively small, the toner is disadvantageous in terms of transferability and cleanability. If the volume average particle diameter is smaller than this range, the toner in a two component development agent (formed of toner and carrier) tends to adhere to the surface of the carrier when the two component development agent is stirred in a development device for a long period of time. This easily deprives the carrier of the charging power. If used in a single component development agent, filming of the toner on a development roller and cohesion of the toner on members such as a blade to regulate the thickness of the toner layer tend to occur.

By contrast, when the toner particle diameter is greater than the range of the present disclosure, quality images with high definitions is not easily produced. In addition, when the toner in a development agent is replenished, variation of the particle diameter of the toner tends to increase. This applies to a case in which the ratio (Dv/Dn) of the volume average particle diameter (Dv) to the number average particle diameter (Dn) is greater than 1.25. In addition, a case in which the ratio (Dv/Dn) is less than 1.05 is preferable in terms of the stabilization of toner and the uniformity of charging size but unable to charge the toner sufficiently or degrades the cleanability in some cases.

The method of manufacturing toner is described about granulating mother toner particles (colored particles) by using a compound having an active hydrogen group and a resin precursor (resin precursor that can produce a modified polyester) that contains a polyester (hereinafter referred to as prepolymer A) having a functional group reactive with the active hydrogen of the compound.

Prepolymer A is obtained by reacting a polyester resin (polyester rein having an active hydrogen group) formed of a polycondensation product of a polyol 1 and a polycarboxylic acid 2 with a polyisocyanate 3.

Specific examples of the active hydrogen group include, but are not limited to, hydroxyl groups (alcohol hydroxyl groups and phenolic hydroxyl groups), amino groups, carboxyl groups, and mercarpto groups. Alcohol hydroxyl group is preferable. "The polyester resin having an active hydrogen group" here is different from "the compound having an active hydrogen group".

Specific examples of the polyols (1) include, but are not limited to, alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F, and bisphenol S), 4,4'-dihydroxybiphenyls such as 3,3-difluoro-4,4'-dihydroxybiphenyl; bis(hydroxyphenyl)alkanes such as bis(3-fluoro-4-hydroxyphenyl)methane, 1-phenyl-1,1'-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also referred to as tetrafluorobisphenol A), and 2,2-bis(3-hydroxyphnyl)-1,1,1,3,3,3-hexafluoropropane; bis(4-hydrorxyphenyl)ethers such as bis(3-fluoro-4-hydroxyphenyl)ether; adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide). Alkylene glycols having 2 to 12 carbon atoms and adducts of a bisphenol with an alkylene oxide are preferable. A mixture of an adduct of a bisphenol with an alkylene oxide and an alkylene glycol having 2 to 12 carbon atoms is particularly preferable.

Specific examples of the polyol 1 having three or more hydroxyl groups include, but are not limited to, tri- or higher aliphatic alcohols (such as glycerin, trimethylol ethane, trimethylol propane, pentaerythritol and sorbitol); polyphenols having three or more hydroxyl groups (such as trisphenol PA, phenolic novolak and cresol novolak); and adducts of the polyphenols having three or more hydroxyl groups mentioned above with an alkylene oxide. The polyols specified above can be used alone or in combination.

Specific examples of the polycarboxylic acids (2) include, but are not limited to, alkylene dicarboxylic acids (e.g., succinic acid, adipic acid and sebacic acid); alkenylene dicarboxylic acids (e.g., maleic acid and fumaric acid); and aromatic dicarboxylic acids (e.g., phthalic acid, isophthalic acid, terephthalic acid, naphthalene dicarboxylic acids, 3-fluoroisophtahlic acid, 2-fluoroisophthalic acid, 2-fluoroterephtahlic acid, 2,4,5,6-tetrafluoroisophtahlic acid, 2,3,5,6-tetrafluoro terephthalic acid, 5-trifluoromthyl isophthalic acid, 2,2-bis(4-carboxyphenyl)hexafluoropropane, 2,2-bis(4-carboxyphenyl)hexafluoro propane, 2,2-bis(3-carboxyphenyl) hexafluoropropane, 2,2'-bis(trifluoromethyl)-4,4'-biphenyl dicarboxylic acid, 3,3'-bis(trifluoromethyl)4,4'-biphenyl dicarboxylic acid, 2,2'-bis(trifluoromethyl)-3,3'-biphenyl dicarboxylic acid, and hexafluoro isopropylidene diphthalic anhydride). Among these compounds, alkenylene dicarboxylic acids having 4 to 20 carbon atoms and aromatic dicarboxylic acids having 8 to 20 carbon atoms are preferable.

Furthermore, specific examples of the polycarboxylic acids having three or more hydroxyl groups include, but are not limited to, aromatic polycarboxylic acids having 9 to 20 carbon atoms (e.g., trimellitic acid and pyromellitic acid), anhydrides thereof, or lower alkyl esters (e.g., methyl esters, ethyl esters or isopropyl esters).

The polycarboxylic acids can be used alone or in combination and are not limited to the specified above.

With regard to the ratio of polyol 1 to polycarboxylic acid 2 when synthesizing a polyester resin, the equivalent ratio of [OH]/[COOH] of hydroxyl group [OH] to carboxyl group [COOH] is from 2/1 to 1/1, preferably from 1.5/1 to 1/1, and more preferably from 1.3/1 to 1.02/1.

The peak molecular weight of the polyester is from 1,000 to 30,000, preferably from 1,500 to 10,000, and more preferably from 2,000 to 8,000. When the peak molecular weight is too small, the high temperature storage tends to deteriorate. When the peak molecular weight is too large, the low temperature fixability tends to deteriorate.

Specific examples of the polyisocyanates 3 include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic aliphatic diisocyanates (e.g., $\alpha,\alpha,\alpha',\alpha'$-tetramethyl xylylene diisocyanate); isocyanurates; and blocked polyisocyanates in which the polyisocyanates mentioned above are blocked with phenol derivatives, oximes or caprolactams. These coloring agents can be used alone or in combination.

A suitable mixing ratio (i.e., [NCO]/[OH]) of the polyisocyanate 3 to a polyester resin having a hydroxyl group to synthesize a prepolymer A is from 5/1 to 1/1, preferably from 4/1 to 1.2/1, and more preferably from 2.5/1 to 1.5/1. When the [NCO]/[OH] is too large, the low temperature fixability tends to deteriorate. When the [NCO]/[OH] is too small, the content of the urethane group and/or the urea group in a modified polyester resin decreases, which may lead to deterioration of hot offset resistance.

The content of the composition derived from polyisocyanate 3 in prepolymer A is from 0.5% by weight to 40% by weight, preferably from 1% by weight to 30% by weight, and more preferably from 2% by weight to 20% by weight. A content that is too low tends to degrade the hot offset resistance of toner. By contrast, when the content is too high, the low temperature fixability of toner easily deteriorates. The number of isocyanate groups contained in one molecule of the prepolymer A is normally not less than 1, preferably from 1.5 to 3, and more preferably from 1.8 to 2.5. When the number of isocyanate groups is too small, the molecular weight of a modified polyester resin decreases, which leads to deterioration of hot offset resistance in some cases.

In the present disclosure, amine B is used as the compound (elongating agent and/or cross-linking agent) having an active hydrogen group reactive with the prepolymer A. Specific examples of the amines B include, but are not limited to, diamine B1, polyamine B2 having three or more amino groups, amino alcohols (B3), amino mercaptans (B4), amino acids (B5), and blocked amines (B6) in which the amino group of the amines B1 to -B5 mentioned above are blocked.

Specific examples of the diamine B1 include, but are not limited to, aromatic diamines (e.g., phenylene diamine, diethyltoluene diamine, 4,4'-diaminodiphenyl methane, tetrafluoro-p-xylylene diamine, and tetrafluoro-p-phenylene diamine); alicyclic diamines (e.g., 4,4' f-diamino-3,3'-dimethyldicyclohexyl methane, diaminocyclohexane, and isophorone diamine); aliphatic diamines (e.g., ethylene diamine, tetramethylene diamine, hexamethylene diamine, dodecafluoro hexylene diamine, and tetracosa fluoro dodecylene diamine).

Specific examples of the polyamine B2 having three or more amino groups include, but are not limited to, diethylene triamine and triethylene tetramine.

Specific examples of the amino alcohols B3 include, but are not limited to, ethanol amine and hydroxyethyl aniline.

Specific examples of the amino mercaptan B4 include, but are not limited to, aminoethyl mercaptan and aminopropyl mercaptan.

Specific examples of the amino acids B5 include, but are not limited to, amino propionic acid and amino caproic acid.

Specific examples of the blocked amine B6 include, but are not limited to, ketimine compounds which are prepared by reacting one of the amines B1 to B5 mentioned above with a ketone (such as acetone, methyl ethyl ketone, and methyl isobutyl ketone); and oxazoline compounds.

Furthermore, the molecular weight of the modified polyester resin can be adjusted by an optional molecular weight control agent in the cross linking reaction and/or the elongation reaction Specific preferred examples of the molecular weight control agent include, but are not limited to, monoamines (e.g., diethyl amine, dibutyl amine, butyl amine, and lauryl amine) and blocked amines (i.e., ketimine compounds) prepared by blocking the monoamines mentioned above.

The equivalent ratio ([NCO]/[NHx]) of isocyante group [NCO] of the prepolymer A and amino group [NHx] of the amine B when conducting reaction therebetween is from ½ to 2/1, preferably from 1.5/1 to 1/1.5 and more preferably from 1.2/1 to 1/1.2. When the equivalent ratio is too large or small, the molecular weight of an obtained modified polyester resin decreases, which leads to deterioration of hot offset resistance.

The organic solvent to dissolve or disperse a material (toner composition) is preferably volatile with a boiling point lower than 100° C. in order to easily remove the organic solvent later. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone, and methylisobuthyl ketone. These can be used alone or in combination. In particular, ester based solvents such as methyl acetate and ethyl acetate, aromatic based solvent such as toluene and xylene, and halogenized hydrocarbons such as methylene chloride, 1,2-dichloroethane, chloroform and carbon tetrachloride are preferable.

The toner composition can be simultaneously dissolved or dispersed but typically dissolved or dispersed in separate occasions. It is not necessary to use the same organic solvent to dissolve or disperse each of the toner composition, but using the same organic solvent is preferable considering the subsequent solvent treatment.

The solution or liquid dispersion {toner liquid material (oil phase)} of a toner composition preferably has a resin density of from 40% by weight to 80% by weight. When the resin density is too high, it is not easy to dissolve or disperse the toner composition and the viscosity thereof increases, which makes handling of the solution or liquid dispersion difficult. When the resin density is too low, the yield of the toner becomes less. When a polyester resin is mixed with a prepolymer, these can be mixed in the same solution or liquid dispersion or manufactured on separate occasions.

Considering the solubility and the viscosity of each, it is preferable to prepare a solution or liquid dispersion on separate occasions.

The coloring agent can be separately dissolved or dispersed or mixed with the solution or liquid dispersion of a polyester resin. If desired, a dispersion helping agent or a polyester resin can be added or a master batch above can also be used as described above.

When wax is dissolved or dispersed as a releasing agent and an organic solvent in which the wax is not soluble is used, the resultant is used as a liquid dispersion. Such a liquid dispersion is prepared by a typical method, in which an organic solvent and a wax are mixed followed by dispersion by a dispersion device such as a bead mill. Alternatively, after mixing an organic solvent and wax, the wax is heated to the melting point thereof and cooled down while stirring the mixture and thereafter, the mixture is dispersed by a dispersion device such as a bead mill. In this case, the dispersion time can be reduced in some cases. Furthermore, several kinds of waxes can be mixed for use and a dispersion improving agent or a polyester resin can be optionally added.

Suitable aqueous media is not limited to water only. A mixture of water with a solvent which can be mixed with water is also suitably used.

Specific examples of such solvents that can be mixed with water include, but are not limited to, alcohols (e.g., methanol, isopropanol, and ethylene glycol), dimethylformamide, tetrahydrofuran, cellosolves (e.g., methyl cellosolve), lower ketones (e.g., acetone and methyl ethyl ketone), etc.

The content of the aqueous medium is normally from 50 parts by weight to 2,000 parts by weight and preferably from 100 parts by weight to 1,000 parts by weight based on 100 parts by weight of a toner composition.

When the content of the aqueous medium is too small, the dispersion state of the toner composition is easily degraded. A content of an aqueous medium that is excessively large is not preferred in terms of cost efficiency.

When a solution of a liquid dispersion of a toner composition is dispersed in an aqueous medium, it is preferable to preliminarily disperse an inorganic dispersing agent or a resin particles in an aqueous medium. In this case, the particle size distribution becomes sharp and the dispersion is stabilized.

Specific examples of the inorganic dispersing agent include, but are not limited to, tricalcium phosphate, calcium carbonate, titanium oxide, colloidal silica, and hydroxyapatite.

There is no specific limit to selection of the resin that forms resin particles and any resin that can form an aqueous dispersion element can be used. Any thermoplastic resin or thermocuring resin can be used. Specific examples thereof include, but are not limited to, vinyl based resins, polyurethane resins, epoxy resins, polyester resins, polyamide resins, polyimide resins, silicon based resins, phenolic resins, melamine resins, urea resins, aniline resins, ionomer resins, and polycarbonate resins.

These resins can be used alone or in combination. Among these resins, vinyl resins, polyurethane resins, epoxy resins, polyester resins, and mixtures thereof are preferably used because an aqueous dispersion element containing fine spherical resin particles can be easily prepared.

To emulsify and/or disperse a solution or a liquid dispersion of a toner component in an aqueous medium, a surface active agent can be used, if desired. Specific examples of the surface active agents include, but are not limited to, anionic surface active agents such as alkylbenzene sulfonic acid salts, α-olefin sulfonic acid salts, and phosphoric esters; cationic surface active agents of amine salts (e.g., alkyl amine salts, aminoalcohol fatty acid derivatives, polyamine fatty acid derivatives and imidazoline); cationic surface active agents of quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surface active agents such as fatty acid amide derivatives, polyhydric alcohol derivatives; and ampholytic surface active agents such as alanine, dodecylbis(aminoethyl)glycin, bis(octylaminoethyl-e)glycin, and N-alkyl-N,N-dimethylammonium betaine.

An extremely small amount of a surface active agent having a fluoroalkyl group is effective for a good dispersion. Specific examples of the anionic surface active agents having a fluoroalkyl group include, but are not limited to, fluoroalkyl carboxylic acids having from 2 to 10 carbon atoms and their metal salts, disodium perfluorooctanesulfonylglutamate, sodium 3-{ω-fluoroalkyl(C6-C11)oxy}-1-alkyl(C3-C4) sulfonate, sodium 3-{ω-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10) sulfone amidepropyltrimethylammonium salts, salts of perfluoroalkyl(C6-C10)-N-ethylsulfonyl glycin, monoperfluoroalkyl(C6-C16) ethylphosphates, etc. Specific examples of the cationic surface active agents include, but are not limited to, primary, secondary, or tertiary aliphatic amino acids having a fluoroalkyl group, aliphatic quaternary ammonium salts (for example, perfluoroalkyl(C6-C10)sulfoneamide propyltrimethyl ammonium salts), benzalkonium salts, benzetonium chloride, pyridinium salts, and imidazolinium salts.

Droplets of liquid dispersion can be stabilized by using a polymer protection colloid. Specific examples of such polymeric protection colloids include, but are not limited to, acids (e.g., acrylic acid, methacrylic acid, α-cyanoacrylic acid, α-cyanomethacrylic acid, itaconic acid, crotonic acid, fumaric acid, maleic acid, and maleic anhydride), (meth) acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylate, diethyleneglycol monomethacrylate, glycerinmonoacrylate, N-methylolacrylamide and N-methylolmethacrylamide); vinyl alcohol and its ethers (e.g., vinyl methyl ether, vinyl ethyl ether, and vinyl propyl ether), esters of vinyl alcohol with a compound having a carboxyl group (i.e., vinyl acetate, vinyl propionate, and vinyl butyrate); acrylamide, methacrylamide, and diacetoneacrylamide and their methylol compounds, acid chlorides (e.g., acrylic acid chloride and methacrylic acid chloride); monomers having a nitrogen atom or a heterocyclic ring having a nitrogen atom (e.g., vinyl pyridine, vinyl pyrrolidone, vinyl imidazole, and ethylene imine); polyoxyethylene compounds (e.g., polyoxyethylene, polyoxypropylene, polyoxy ethylene alkyl amines, polyoxypropylene alkyl amines, polyoxy ethylenealkyl amides, polyoxypropylene alkyl amides, polyoxyethylene nonylphenyl ethers, polyoxyethylene lauryl phenyl ethers, polyoxyethylene stearylphenyl esters, and polyoxyethylene nonylphenyl esters), and cellulose compounds (e.g., methyl cellulose, hydroxyethyl cellulose, and hydroxy propyl cellulose).

When compounds such as calcium phosphate which are soluble in an acid or alkali are used as a dispersion stabilizer, it is possible to dissolve the calcium phosphate by adding an acid, for example, hydrochloric acid, followed by washing of the resultant particles with water, to remove the calcium phosphate from the colored particles. In addition, a zymolytic method can be used to remove such compounds. When a dispersing agent is used, it is possible to use colored particles on which the dispersing agent remains but it is preferable to wash and remove the dispersing agent in terms of the chargeability of toner.

There is no particular limit to the dispersion method. Low speed shearing methods, high speed shearing methods, friction methods, high pressure jet methods, ultrasonic methods, etc., can be used. The high speed shearing method is preferable to obtain a dispersion element having a particle diameter of from 2 μm to 20 μm. When a high speed shearing type dispersion machine is used, there is no particular limit to the rotation speed thereof, but the rotation speed is typically from 1,000 rpm to 30,000 rpm and preferably from 5,000 rpm to 20,000 rpm. There is no specific limit to the dispersion time but the dispersion time is typically from 0.1 minutes to 5 minutes in the batch system. The temperature during dispersion is typically from 0° C. to 150° C. (under pressure) and preferably from 20° C. to 80° C.

In order to remove the organic solvent from the thus prepared emulsion dispersion element, a method is used in which the temperature of the entire system is gradually raised at normal pressure or a reduced pressure to completely evaporate and remove the organic solvent in the droplets. Alternatively, it is possible to air-spray the emulsion dispersion element in a dry atmosphere to remove the organic solvent in the droplet and also evaporate and remove surface active agent. The dry atmosphere can be prepared by heating gases, for example, air, nitrogen, carbon dioxide gas, and combustion gases but each kind of air stream heated to temperatures to the boiling point or higher is used in general. At this point, the processing time can be shortened by using a spray drier, a belt drier, or a rotary kiln.

The amine B can be mixed in an organic solvent before dispersing a toner composition in an aqueous medium or added to an aqueous medium. The time to be taken for reaction of the prepolymer A and the amine B is determined depending on the reactivity of the prepolymer A and the amine B. The reaction time is typically from 1 minute to 40 hours and preferably from 1 hour to 24 hours. The reaction temperature is normally from 0° C. to 150° C. and preferably from 20° C. to 98° C. Any known catalyst can be optionally used.

Known methods are applied in washing and drying mother toner particles (colored particles) dispersed in an aqueous medium. That is, after separating into solid and liquid by a centrifugal or a filter press to obtain a toner cake, the obtained cake is re-dispersed in deionized water at room temperature to about 40° C. Subsequent to optional pH adjustment by an acid or an alkali, the resultant is subject to the solid and liquid separation treatment again.

This cycle is repeated several times to remove impurities, and the active surface agent. Thereafter, the resultant is dried by an air stream drier, a circulation drier, a reduced pressure drier, a vibration flow drier, etc. to obtain colored particles. To obtain a toner having a desired particle size distribution, particulate component is removed by a centrifugal or a known classifier optionally used after drying.

The development agent of the present disclosure is a single-component development agent simply formed of the toner of the present disclosure or a two component development agent formed of carrier and the toner of the present disclosure. For a high performance printers, etc. that match the improvement of the processing speed, using a two component development agent is preferable in terms of the length of the working life of the machine.

The mixing ratio of the toner to the carrier in a two component development agent is preferably 1 part by weight to 10 parts by weight based on 100 parts by weight of the carrier.

When a single-component development agent is used and replenished, the variation of the particle diameter of the toner is small without filming of the toner on a developing roller or fusion bonding of the toner onto members such as a blade for regulating the thickness of a toner layer. Therefore, good and stable developability and production of quality images are sustained even when the development agent is used and stirred for an extended period of time.

In a case of a two-component development agent using the toner of the present disclosure, even when the toner is replenished for an extended period of time, the change in the particle diameter of the toner in the development agent is small. In addition, good and stable developability is sustained even when the development agent is stirred in a development device for an extended period of time.

There is no specific limit to the carrier. A carrier is preferable which has a core material and a resin layer that covers the core material.

There is no specific limit to the material for the core material and any known material can be suitably used. For example, manganese-strontium (Mn—Sr) based materials and manganese-magnesium (Mn—Mg) based materials having 50 emu/g to 90 emu/g are preferable. To secure image density, highly magnetized materials such as iron powder having 100 emu/g or more and magnetite having 75 emu/g to 125 emu/g are preferable. In addition, weakly magnetized copper-zinc (Cu—Zn) based materials having 30 emu/g to 80 emu/g are preferable in terms of reducing the impact of a toner filament formed on a development roller on an image bearing member, which is advantageous in improvement of the image quality. These can be used alone or in combination.

The core material preferably has a volume average particle diameter of from 10 μm to 200 μm and more preferably from 40 μm to 100 μm. When the weight average particle diameter is less than 10 μm, fine powder component of the carrier tends to increase and the magnetization per particle tends to decrease, which leads to scattering of the carrier particles. When the weight average particle diameter is greater than 150 μm, the specific surface area tends to decrease, resulting in scattering of toner. In a full color image in which solid portions account for a large ratio, reproducibility tends to deteriorate particularly in the solid portions.

There is no specific limit to the materials for the resin layer and any known resin can be suitably selected to a particular application. Specific examples thereof include, but are not limited to, amino-based resins, polyvinyl-based resins, polystyrene-based resins, polycarbonate-based resins, polyethylene resins, polyvinyl fluoride resins, polyvinylidene fluoride resins, polytrifluoroethylene resins, polyhexafluoropropylene resins, copolymers of vinylidenefluoride and acrylate monomer, copolymers of vinylidenefluoride and vinylfluoride, fluoroterpolymers such as terpolymers of tetrafluoroethylene, fluorovinylidene, and monomer including no fluorine atom, and silicone resins. These can be used alone or in combination.

Specific examples of the amino-based resins include, but are not limited to, urea-formaldehyde resins, melamine resins, benzoguanamine resins, urea resins, polyamide resins, and epoxy resins.

Specific examples of the polyvinyl-base resins include, but are not limited to, acrylic resins, polymethyl methacrylate resins, polyacrylonitrile resins, polyvinyl acetate resins, polyvinyl alcohol resins, and polyvinyl butyral resins. Specific examples of the polystyrene resins include, but are not limited to, polystyrene resins and styrene-acrylic copolymers. A specific example of the halogenated olefin resins includes, but are not limited to, polyvinly chloride. Specific examples of the polyester resins include, but are not limited to, polyethylene terephthalate and polybutylene terephthalate.

The resin layer optionally contains electroconductive powder. Specific examples of such electroconductive powder include, but are not limited to, metal powder, carbon black, titanium oxide, tin oxide, and zinc oxide. The average particle diameter of such electroconductive powder is preferably 1 μm or less. When the average particle diameter is too large, controlling the electric resistance may become difficult.

The resin layer described above can be formed by, for example, dissolving a silicone resin, etc. in a solvent to prepare a liquid application and applying the liquid application to the surface of the core material described above by a known application method followed by drying and baking. Specific examples of the application methods include, but are not limited to, a dip coating method, a spray coating method, and a brushing method.

There is no specific limit to the solvent and the solvent can be selected to a particular application. Specific examples thereof include, but are not limited to, toluene, xylene, methylethylketone, methylisobutyll ketone, and methyl cellosolve, and butylacetate.

There is no specific limit to the baking. An external heating system or an internal heating system can be used. For example, a fixed electric furnace, a fluid electric furnace, a rotary electric furnace, a method of using a burner furnace, and a method of using a microwave can be suitably used.

The content of the resin layer in carrier is preferably from 0.01% by weight to 5.0% by weight. A content that is less than 0.01% by weight tends to make it difficult to form a uniform layer on the surface of the core material. A content that is greater than 5.0% by weight tends to result in an excessively thick resin layer, thereby causing granulation between carrier particles.

As described above, the development agent of the present disclosure is suitably usable for image forming employing known electrophotography such as a magnetic single-component development method, a non-magnetic single-component development method, and a two-component development method. Since the development agent contains the toner of the present disclosure, quality images are formed which have excellent cleanability, quality of images, and durability when conducting image forming by an electrophotographic method using the development agent.

Since the toner container of the present disclosure accommodates the toner of the present disclosure, quality images are formed which have excellent cleanability, quality of images, and durability when conducting image forming by an electrophotographic method using the toner of the present disclosure.

The image forming method of the present disclosure includes at least: a process of charging the surface of an image bearing member; a process of developing a latent electrostatic image formed on the charged image bearing member with the development agent of the present disclosure; a process of transferring the toner image formed on the image bearing member to an image supporting member (image recording medium); and a process of fixing the transferred toner image with a fixing member having a roller-like form or a belt-like form by applying heat and pressure to obtain a fixed image with other optional processes such as a discharging process, a cleaning process, a recycling process, and a control process.

The image forming apparatus of the present disclosure has at least: a charging device (charger); an image bearing member (latent image bearing member; photoreceptor); a development device that accommodates the toner of the present disclosure to develop the latent electrostatic image formed on the image bearing member by the charging device; a transfer device to transfer the toner image formed on the image bearing member to an image supporting member; and a fixing device to fix the transferred toner image by a fixing member to obtain a fixed image with other suitably selected optional devices such as a discharging, a cleaning device, a recycling device, and a controlling device.

The image forming apparatus described above has a process cartridge detachably attachable to the image forming apparatus, which integrally supports at least a latent image bearing member (image bearing member) where a latent electrostatic image is formed and a development device to develop the latent electrostatic image formed on the image bearing member with the development agent of the present disclosure. The process cartridge furthermore integrally supports other suitably selected optional devices.

The toner of the present disclosure can be used accommodated in a toner container.

The process cartridge provided to an image forming apparatus for use in the image forming method of the present disclosure has at least an image bearing member and a development device to develop a latent electrostatic image formed on the image bearing member using the toner of the present disclosure to form a visible image. The process cartridge is detachably attachable to an image forming apparatus and user friendly. In addition, since the toner of the present disclosure is used, quality images having excellent cleanability, quality of images, and durability are produced.

As described above, the image forming method of the present disclosure includes at least a latent electrostatic image forming process, a development process, a transfer process, and a fixing process. In an image forming apparatus for use in the image forming method, a latent electrostatic image is formed on a latent image bearing member in the latent electrostatic image forming process described above. In the development process described above, the latent electrostatic image is developed with the toner of the present disclosure to form a visible image. In the transfer process described above, the visible image is transferred to a recording medium In the fixing process described above, the transferred image to the recording medium is fixed. As a result, a quality image having excellent cleanability, quality of images, and durability is produced.

Each process and device are described in detail below.

In the latent electrostatic image forming process, latent electrostatic images are formed on an image bearing member. Latent electrostatic images can be formed by, for example, applying a bias to the surface of an image bearing member with a charging device to uniformly charge the surface; and exposing the surface to light using an irradiator according to image data.

There is no specific limit to the material, the form, the structure, and size of an image bearing member and any known image bearing member can be suitably selected to a particular application. A drum-like form is preferable. Inorganic image bearing members formed of amorphous silicon, selenium, etc. and organic photoconductor (OPC) formed of polysilane, phthalopolymethine, etc. are used as the image bearing member. In particular, amorphous silicon image bearing members are preferable in terms of the length of working life.

There is no specific limit to the charging device and any charging device can be selected to a particular application to a particular application. For example, a known contact type charging device having an electroconductive or semi-conductive roller, brush, film, or rubber blade or a known non-contact type charging device such as corotron, or scorotron using corona discharging are suitably used.

In addition, it is preferable that the charging device is arranged in contact or not in contact with an image bearing member and charges the surface of the image bearing member by applying a direct voltage or a direct voltage on which an alternating voltage is superimposed to the surface of an image bearing member.

Moreover, it is preferable that the charging device is a charging roller arranged in the proximity via a gap tape to be not in contact with an image bearing member and charges the surface of the image bearing member by applying a direct voltage or a direct voltage on which an alternating voltage is superimposed to the charging roller.

Any irradiation device that can irradiate the surface of an image bearing member charged by a charging device according to image data is suitably selected and used. Specific examples of such irradiating devices include, but are not limited to, a photocopying optical system, a rod lens array system, a laser optical system, or a liquid crystal shutter optical system. Furthermore, a rear side irradiation system in which the image bearing manger is irradiated from the rear side thereof can be also employed.

The development process is to form a visible image by developing a latent electrostatic image with the development agent of the present disclosure.

Any known development device that can conduct development with the toner or the development agent of the present disclosure is usable and suitably selected to a particular application. For example, it is preferable to use a development device that accommodates the toner or the development agent of the present disclosure and includes at least a development agent bearing member which provides the toner or the development agent to a latent electrostatic image in a contact or non-contact manner.

The development device is either of a dry development type or a wet development type and in addition can be a single color development type or a multi-color development type. A development device is suitable that includes, for example, a stirrer that triboelectrically charges the toner or the development agent and a rotary magnet roller. In the development device, for example, toner and carrier are mixed and stirred to triboelectrically charge the toner. The charged toner stands on the surface of the rotating magnet roller like filaments to form a magnetic brush. Since the magnet roller is provided in the vicinity of an image bearing member, part of the toner forming the magnet brush borne on the surface of the magnet roller is transferred to the surface of the image bearing member by electric attraction force. As a result, the latent electrostatic image is developed with the toner to form a visible toner image on the surface of the image bearing member. It is preferable to apply an alternating electric field to move the toner to the surface of the image bearing member.

The transfer process is to transfer a visible image to a transfer element (transfer medium) by a transfer device. It is preferable to employ a system in which a visible image is primarily transferred to an intermediate transfer body and thereafter secondarily transferred to a transfer element. Moreover, it is also preferable to employ a system including a primary transfer process of transferring a visible image developed with two or more color toner, preferably, full color toner, to an intermediate transfer body to form a complex transferred image and a secondary transfer process of transferring the complex transferred image to a transfer body. The visible image can be transferred by, for example, a transfer charger to charge the image bearing member.

The transfer device preferably has a primary transfer device to form a complex transfer image by transferring the visible image to the intermediate transfer body and a secondary transfer device to transfer the complex transfer image to transfer element (recording medium). The transfer device (the primary transfer device and the secondary transfer device) preferably has a transfer unit that peels off the visible image formed on the image bearing member toward the transfer medium. It is suitable to provide a single or more transfer devices. Specific examples of the transfer units include, but are not limited to, a corona transfer unit employing corona discharging, a transfer belt, a transfer roller, a pressure transfer roller, and an adhesive transfer unit.

There is no specific limit to the intermediate transfer body and it is possible to make a choice from known devices to a particular application. For example, a transfer belt is suitable.

There is no specific limit to the transfer element and any known recording medium (typically recording paper) can be suitably used.

The fixing process is to fix a visible image transferred to a transfer element by a fixing device. Fixing can be conducted every time a color toner image is transferred or at once for a multi-color overlapped image.

There is no specific limit to the fixing device and it can be suitably selected to a particular application. It is preferable to conduct fixing by heat and pressure by using a known fixing member. The fixing member preferably has a roller-like form or a belt like form. For example, it is suitable to use a combination of a hearing roller and a pressure roller or a combination of a heating roller, a pressure roller, and an endless belt. The heating temperature is preferably from 80° C. to 200° C.

In the present disclosure, it is suitable to use a fixing device including a heating substance that has a heating element, a film that contacts the heating substance, and a pressure member that is pressed against the heating substance via the film and conducting heat and pressure fixing while the transfer element (transfer medium) on which an un-fixed image is formed passes between the film and the pressure member.

Depending on particular applications, for example, a known optical fixing device can be used together with or instead of the fixing device.

The discharging process is to apply a discharging bias to an image bearing member to conduct discharging by a discharging device.

There is no specific limit to the discharging device if a discharging bias can be applied to an image bearing member and any known discharging device can be used. For example, a discharging lamp is suitable.

The cleaning process is to remove toner remaining on an image bearing member by using a cleaner.

Any known cleaning device that can remove the toner remaining on the surface of the image bearing member can be selected and used. For example, a magnetic brush cleaner, an electrostatic brush cleaner, a magnetic roller cleaner, a blade cleaner, a brush cleaner, and a web cleaner are suitable.

The recycling process is to return toner removed in the cleaning process to the development device for reuse by using a recycling device.

There is no specific limit to the recycling device. For example, any known transfer device is suitable.

The control process is to control each process by a controller.

There is no specific limit to the controller as long as the controller controls the behavior of each device. For example, devices such as a sequencer and a computer are suitable.

Having generally described preferred embodiments of this invention, further understanding can be obtained by reference to certain specific examples which are provided herein for the purpose of illustration only and are not intended to be limiting.

In the descriptions in the following examples, the numbers represent weight ratios in parts, unless otherwise specified.

EXAMPLES

Next, the present disclosure is described in detail with reference to Examples and Comparative Examples but not limited thereto.

Manufacturing of Mother Toner Particle by Emulsification method—Oil Phase/Aqueous Phase Synthesis of Particulate Liquid Dispersion The following recipe was placed in a reaction container equipped with a stirrer and a thermometer and stirred at 400 rotations per minute (rpm) for 5 minutes to obtain a white emulsion:

Water 683 parts

Sodium salt of a sulfuric acid ester of an adduct of methacrylic acid with ethyleneoxide (EREMINOR RS-30, manufactured by Sanyo Chemical Industries, Ltd.): 11 parts Styrene: 83 parts Methacrylic acid: 83 parts Butyl acrylate: 110 parts Ammonium persulfate: 1 part The system was heated to 75° C. to conduct reaction for five hours. Furthermore, 30 parts of 1% ammonium persulfate aqueous solution followed by aging at 75° C. for five hours to obtain an aqueous liquid dispersion of [Particulate liquid dispersion 1] of a vinyl resin (copolymer of sodium salt of sulfuric acid of styrene-methacrylic acid-butyl acrylate-an adduct of methacrylic acid with ethyleneoxide.

[Particulate liquid dispersion 1] had a weight average particle diameter of 105 nm as measured by LA-920. A resin portion was isolated by drying a portion of [Particulate liquid dispersion 1].

The resin portion has a glass transition temperature (Tg) of 59° C. and a weight average molecular weight of 150,000.

Preparation of Aqueous Phase 990 parts of deionized water, 83 parts of [Particulate liquid dispersion 1], 37 parts of 48.5% by weight aqueous solution of sodium dodecyldiphenyl etherdisulfonate (EREMINOR MON-7, manufactured by Sanyo Chemical Industries, Ltd.), and 90 parts of ethyl acetate were mixed and stirred to obtain milk white liquid. This was determined as [Aqueous phase 1].

Synthesis of Low Molecular Weight Polyester

The following components are placed in a reaction container equipped with a condenser, a stirrer, and a nitrogen introducing tube to conduct reaction at 230° C. at normal pressure for 8 hours followed by 5 hour reaction with a reduced pressure of 10 mmHg to 15 mmHg:

Adduct of bisphenol A with 2 mols of ethylene oxide: 229 parts

Adduct of bisphenol A with 3 mols of propylene oxide: 529 parts

Terephthalic acid: 208 parts

Trimellitic anhydride: 46 parts

Dibutyl tin oxide: 2 parts

Thereafter, 44 parts of trimellitic acid was put into the reaction container to conduct reaction at 180° C. and normal pressure for 2 hours to obtain [Low Molecular Weight Polyester 1].

[Low Molecular Weight Polyester 1] had a number average molecular weight of 2,500, a weight average molecular weight of 6,700, a glass transition temperature of 43° C., and an acid value of 25 mgKOH/g.

Synthesis of Intermediate Polyester and Prepolymer

The following components were placed in a container equipped with a condenser, a stirrer and a nitrogen introducing tube to conduct reaction at 230° C. under normal pressure for 8 hours followed by another reaction for 5 hours with a reduced pressure of 10 mmHg to 15 mmHg to synthesize [Intermediate polyester 1]:

Adduct of bisphenol A with 2 mols of ethylene oxide: 682 parts

Adduct of bisphenol A with 2 mole of propylene oxide: 81 parts

Terephthalic acid: 283 parts

Trimellitic anhydride: 22 parts

Dibutyl tin oxide: 2 parts

Thus-obtained [Intermediate polyester 1] had a number average molecular weight of 2,100, a weight average molecular weight of 9,500, a glass transition temperature of 55° C., an acid value of 0.5 mgKOH/g, and a hydroxyl value of 51 mgKOH/g.

Next, 410 parts of [Intermediate polyester 1], 89 parts of isophorone diisocyanate, and 500 parts of ethyl acetate were placed in a reaction container equipped with a condenser, stirrer, and a nitrogen introducing tube to conduct reaction at 100° C. for 5 hours to obtain [Prepolymer 1].

The weight % of the isolated isocyanate of [Prepolymer 1] was 1.53%.

Synthesis of Ketimine 170 parts of isophoronediamine and 75 parts of methyl ethyl ketone were placed in a reaction container equipped with a stirrer and a thermometer to conduct reaction at 50° C. for 5 hours to obtain [Ketimine compound 1].

[Ketimine compound 1] had an amine value of 418 mgKOH/g.

Synthesis of Master Batch 35 parts of water, 40 parts of phthalocyanine pigment FG 7351 (manufactuerd by Toyo Ink Co., Ltd.), and 60 parts of polyester resin RS 801 (manufactured by Sanyo Chemical Industries) were mixed by a HENSCHEL MIXER (manufactured by NIPPON COKE & ENGINEERING. CO., LTD.) and the mixture was mixed and kneaded at 150° C. for 30 minutes by a twin-shaft roll and flattened and cooled down followed by pulverization by a pulverizer to obtain [Master batch 1].

Preparation of Oil Phase

The following components were placed in a container equipped with a stirrer and a thermometer.

[Low molecular weight polyester 1]: 378 parts

Carnauba wax: 110 parts

Salicylic acid metal complex (CCA): E-84, manufactured by Orient Chemical Industries, Ltd.): 22 parts Ethyl acetate: 947 parts The mixture was heated to 80° C. while stirring it and thereafter held at 80° C. for 5 hours followed by cooling down to 30° C. in one hour.

Next, 500 parts of [Master batch 1] and 500 parts of ethyl acetate were placed in the container followed by mixing for one hour to obtain a [Raw material solution 1].

1,324 parts of [Raw material solution 1] was transferred to a container to disperse wax and carbon black using a bead mill (ULTRAVISCOMILL from AIMEX) under the following conditions:

Liquid feeding speed: 1 kg/hour

Disc rotation perimeter speed: 6 msec

Diameter of zirconia beads: 0.5 mm

Filling factor of zirconia beads: 80% by volume 3 passes Next, 1,324 parts of 65% ethyl acetate solution of [Low molecular weight polyester 1] was added followed by one pass by the bead mill under the conditions mentioned above to obtain [Pigment liquid dispersion 1].

The concentration of the solid portion of [Pigment liquid dispersion 1] was 50% at 130° C. for 30 minutes.

Emulsification 648 parts of [Pigment liquid dispersion 1], 154 parts of [Prepolymer 1], and 6.6 parts of [Ketimine compound 1] were placed in a container and mixed by a TK HOMOMIXER (manufactured by Tokushu Kika Kogyo Co., Ltd.) at 5,000 rpm for one minute. Thereafter, 1,200 parts of [Aqueous phase 1] was put in the container and the mixture was mixed by the TK HOMOMIXER at 13,000 rpm for 20 minutes to obtain [Emulsified slurry 1].

Form Control 3.15 parts of CELLOGEN™ BS-H (manufactured by DAI-ICHI KOGYO SEIYAKU CO., LTD.) was added little by little to 75.6 parts of deionized water being stirred by a TK HOMOMIXER (manufactured by Tokushu Kika Kogyo Co., Ltd.) at 2,000 rotations per minute (rpm). After the addition, the system was stirred for 30 minutes while keeping the temperature at 20° C.

43.3 parts of 48.5% by weight aqueous solution of sodium dodecyldiphenyl etherdisulfonate (EREMINOR MON-7, manufactured by Sanyo Chemical Industries, Ltd.) was added to the obtained CELLOGEN™ solution followed by stirring for 5 minutes while keeping the temperature at 20° C. 2,000 parts of [Emulsified slurry 1] was added thereto followed by mixing by the TK HOMOMIXER at 2,000 rpm for one hour to obtain [Form controlled slurry 1].

Removal of Solvent

[Emulsified Slurry 1] was placed in a container equipped with a stirrer and a thermometer followed by removal of the solvent at 30° C. for 8 hours. Subsequent to a 4 hour aging at 45° C., [Slurry dispersion 1] was obtained.

Washing to Drying

After 100 parts of [Slurry dispersion 1] was filtered with a reduced pressure;

(1): 100 parts of deionized water was added to the filtered cake followed by mixing by a TK HOMOMIXER (at 12,000 rpm for 10 minutes);

(2): 100 parts of 10% sodium hydroxide was added to the filtered cake obtained in (1) and the resultant was mixed by a TK HOMOMIXER (at 12,000 rpm for 30 minutes) followed by filtration with a reduced pressure;

(3): 100 parts of 10% sodium hydrochloric acid was added to the filtered cake obtained in (1) and the resultant was mixed by a TK HOMOMIXER (at 12,000 rpm for 30 minutes) followed by filtration;

(4): 300 parts of deionized water was added to the filtered cake of (3) and the resultant was mixed by a TK HOMOMIXER at 12,000 rpm for 10 minutes followed by filtration. This process was repeated twice to obtain [Filtered cake 1].

[Filtered cake 1] was dried at 45° C. for 48 hours by a circulating drier. The dried cake was sieved using a screen having an opening of 75 μm to obtain [Mother toner particle A].

[Mother toner particle A] had a volume average particle diameter (Dv) of 5.6 μm.

The resin particle having a silica layer on its surface for use in the present diclosure is obtained by the following method.

Manufacturing of Resin Particulate AA 5.0 g of non-cross-linked acrylic mono-dispersed particulate (MP-300, average particle diameter: 100 nm, manufactured by Soken Chemical Engineering Co., Ltd.) available on the market was placed in a flask equipped with a thermometer, a nitrogen-introducing tube, and a stirrer and 886.9 g of distillated water was put in the flask to conduct nitrogen replacement. After adjusting the temperature in the system to 25° C., 0.66 g of tetramethoxy silane (0.12 g in silicon atom conversion) was placed in the flask while stirring the solution to conduct reaction at 25° C. for 24 hours. Thereafter, the system was heated to 70° C. for further reaction for 6 hours to prepare an aqueous solution that contained non-cross-linked acrylic particulates having surfaces on which silica layers were directly formed, so-called resin particulates having outer shell layers formed of silica. Subsequent to filtration of this aqueous solution with a reduced pressure, the resultant was dried at 45° C. for 24 hours by a circulation dryer. Thereafter, the resultant was screened by a 25 μm mesh to remove coarse particles and pulverizes loosely agglomerated particles to obtain a resin particulate AA having a silica layer (outer layer) on its surface.

Manufacturing of Resin Particulate AB

A resin particulate AB in which a silica layer (outer shell layer) was formed on the surface of PMMA particulate (MP-300) was obtained in the same manner as in the resin particulate AA except that 0.66 g of tetra methoxy silane was changed to 0.91 g (0.12 g in silicon atom conversion) and the reaction time at 25° C. was changed from 24 hours to 120 hours.

Manufacturing of Resin Particulate BA

A resin particulate BA in which silica layer (outer shell layer) was formed on the surface of PMMA particulate (MX-150) was obtained in the same manner as in the resin particulate AA except that non-cross-linked acrylic mono-dispersed particulate (MP-300, average particle diameter: 100 nm, manufactured by Soken Chemical Engineering Co., Ltd.) was changed to cross-linked acrylic mono-dispersed particulate (MX-150, average particle diameter: 1,500 nm, manufactured by Soken Chemical Engineering Co., Ltd.).

The cross-linked acrylic mono-dispersed particulate (MX-150) for use in the resin particulate BA is tougher than the non-cross-linked acrylic mono-dispersed particulate (MP-300) and is not deformed by increasing the mixing strength (Mixing speed) of a HENSCHEL MIXER. Therefore, it is difficult to increase the SF of the cross-linked acrylic mono-dispersed particulate (MX-150) and it has a value as shown in Comparative Example 1.

Manufacturing of Resin Particulate BB

A resin particulate BB in which silica layer (outer shell layer) was formed on the surface of PMMA particulate (MX-150) was obtained in the same manner as in the resin particulate AB except that non-cross-linked acrylic mono-dispersed particulate (MP-300, average particle diameter: 100 nm, manufactured by Soken Chemical Engineering Co., Ltd.) was changed to cross-linked acrylic mono-dispersed particulate (MX-150, average particle diameter: 1,500 nm, manufactured by Soken Chemical Engineering Co., Ltd.).

Manufacturing of Carrier

Carrier for use in a development agent or carrier to measure to the charging size of toner was obtained by applying coating liquid in which 200 parts of silicone resin solution (manufactured by Shin-Etsu Chemicals Co., Ltd.) and 3 part of carbon black (manufactured by Cabot Corporation) were dispersed in toluene to 2,500 parts of ferrite core by a fluid bed type spraying method to cover the surface of the core material followed by two hour baking in an electric furnace at 300° C.

The carrier used had a relatively sharp particle size distribution and an average particle diameter of from 30 μm to 60 μm.

Example 1

Development Agent X1

100 parts of [Mother toner particle A] and 0.75 parts of rutile type titanium oxide which was hydrophobized by isobutyl having an average particle diameter of 15 nm were mixed by a HENSCHEL MIXER in the condition that the stirring wing had a peripheral speed of 35 m/s. Thereafter, 3 parts of the resin particle AA in which a silica layer was formed on the surface was mixed in the condition that the stirring wing had a peripheral speed of 35 m/s to manufacture [Toner X1]. The shape factor (SF) of the resin particle AA was 1.23 when it was attached to the surface of the mother toner particle A of [Toner X1].

The SF value is also shown in Table 1 below.

7 parts of the thus obtained [Toner X1] and 93 parts of [Carrier] were mixed and stirred to prepare [Development agent X1] having a toner concentration of 7% by weight.

Example 2

[Toner X2] was manufactured in the same manner as in Example 1 except that the peripheral speed of the stirring wing of the HENSCHEL MIXER was changed from 35 m/s to 55 m/s to mix the resin particle AB in which the silica layer was formed. The shape factor (SF) of the resin particle AA was 1.41 when it was attached to the surface of the mother toner particle A of [Toner X2].

The SF value is also shown in Table 1 below.

7 parts of the thus obtained [Toner X2] and 93 parts of [Carrier] were mixed and stirred to prepare [Development agent X2] having a toner concentration of 7% by weight.

Example 3

[Toner X3] was manufactured in the same manner as in Example 2 except that the resin particle AA in which the silica layer was formed was changed to the resin particle BB in which the silica layer was formed. The shape factor (SF) of the resin particle BB was 1.36 when it was attached to the surface of the mother toner particle A of [Toner X3]. The SF value is also shown in Table 1 below.

7 parts of the thus obtained [Toner X3] and 93 parts of [Carrier] were mixed and stirred to prepare [Development agent X3] having a toner concentration of 7% by weight.

Comparative Example 1

[Toner Y1] was manufactured in the same manner as in Example 1 except that 3 parts of the resin particle AA in which the silica layer was formed was changed to 3 parts of the resin particle BA in which the silica layer was formed.

The shape factor (SF) of the resin particle BA was 1.10 when it was attached to the surface of the mother toner particle A of [Toner Y1].

The SF value is also shown in Table 1 below.

7 parts of the thus obtained [Toner Y1] and 93 parts of [Carrier] were mixed and stirred to prepare [Development agent Y1] having a toner concentration of 7% by weight.

Comparative Example 2

[Toner Y2] was manufactured in the same manner as in Example 2 except that 3 parts of the resin particle AA in which the silica layer was formed was changed to 3 parts of polymethyl methacrylate (PMMA) particulate (MP-300, average particle diameter: 100 nm, manufactured by Soken Chemical Engineering Co., Ltd.) in which no silica layer was formed on the surface. The shape factor (SF) of the resin particle (PMMA particulate) was 1.43 when it was attached to the surface of the mother toner particle A of [Toner Y2]. The SF value is also shown in Table 1 below.

7 parts of the thus obtained [Toner Y2] and 93 parts of [Carrier] were mixed and stirred to prepare [Development agent Y2] having a toner concentration of 7% by weight.

Comparative Example 3

[Toner Y3] was manufactured in the same manner as in Example 1 except that 3 parts of the resin particle AA in which the silica layer was formed was changed to 3 parts of sol gel method silica (X-24) particle (manufactured by Shin-Etsu Chemical Co., Ltd.).

The shape factor (SF) of the sol gel method silica (X-24) was 1.10 when it was attached to the surface of the mother toner particle A of [Toner Y3]. The SF value is also shown in Table 1 below.

7 parts of the thus obtained [Toner Y3] and 93 parts of [Carrier] were mixed and stirred to prepare [Development agent Y3] having a toner concentration of 7% by weight.

The sol gel method silica (X-24) particle for use in Comparative Example 3 is said to be softer than typical silica manufactured by a combustion method because it is manufactured by a sol gel method but the hardness is almost the same between the two.

Therefore, the sol gel method silica (X-24) particle is not deformed at all if the mixing strength (mixing speed) of a HENSCHEL MIXER increases. Therefore, it is difficult to increase the SF and the SF value is as shown above.

The form (Shape Factor: SF) of the external additive attached to the toner surface of each of Examples and Comparative Examples was measured and calculated as follows:

Calculation of Shape Factor SF The form of an external particle such as a resin particle after the external particle is attached to the surface of a mother toner particle is as follows: FE-SEM (S-4200, manufactured by Hitachi Ltd.) is used to measure scanning electron microscope (SEM) images of external particles and 300 SEM images thereof are picked at random and the thus-obtained image data are introduced into an image analyzer (Luzex, A P, manufactured by Nireco Corporation) via an interface to conduct analysis to calculate the particle form (shape factor: SF) when the external particles is attached to the toner surface by the following relation 1:

$$\text{Shape factor(SF)}=[(\text{Absolute maximum length of particle})^2/\text{Projected area of particle})]\times(\pi/4) \quad \text{Relation 1}$$

Evaluation

Quality of image, granularity and sharpness of image, fixability, and high temperature stability of the development agents of X1 to X3 and Y1 to Y3 of Examples 1 to 3 and Comparative Examples 1 to 3, respectively, were evaluated in total by using an image forming apparatus having the following structure. The conditions of the evaluation items are described below.

The evaluation results are shown in Table 1.

Image Forming Apparatus

The structure of the image forming apparatus for use in evaluation is as follows: In the image forming apparatus, there are provided: a charging roller located in contact with or in the proximity of a drum photoreceptor serving as an image bearing member to charge the drum photoreceptor; an irradiator to form a latent electrostatic image on the drum photoreceptor; a development device to render the latent electrostatic image visible with a development agent to obtain a toner image; a transfer belt to transfer the toner image to a transfer sheet; a cleaning device to remove toner remaining on the drum photoreceptor; a discharging lamp to discharge residual charge on the drum photoreceptor, and an optical sensor to control the voltage applied by the charging roller and the toner concentration of the development agent. In addition, the toner of each of Examples or Comparative Examples is replenished to the development device by a toner supplying device via a toner supplying mouth. The imaging operation by the image forming apparatus is as follows: The drum photoreceptor rotates counterclockwise. The drum photoreceptor is discharged by discharging light to have an averaged surface voltage of 0 V to −150 V as the reference voltage. Next, the drum photoreceptor is charged by the charging roller to have a surface voltage of about −1,000 V. Next, the surface of the drum photoreceptor irradiated by the irradiator has a surface voltage of from 0 V to −200 V at the irradiated portion (image portion).

The toner on the sleeve is attached to the image portion by the development device.

The drum photoreceptor on which a toner image is formed rotatarily moves and a transfer sheet is fed from a sheet feeding unit in such a timing that the front end of the transfer sheet contacts the front end of the image at the transfer belt to transfer the toner image on the drum photoreceptor to the transfer sheet by the transfer belt. Thereafter, the transfer sheet is sent to a fixing unit where the toner adheres to the transfer sheet by heat and pressure and thereafter discharged as a photocopy.

The toner remaining on the drum photoreceptor is scraped off by the cleaning blade in the cleaning device. Thereafter residual charge is removed from the drum photoreceptor by discharging light to be back to the initial state thereof and ready for producing the next image.

Evaluation Item

In the image forming apparatus described above, the toner and the development agent of Examples and Comparative Examples are evaluated as to the following items.

1. Image Quality

Image quality was evaluated totally for degradation (to be specific, poor transfer performance, production of background fouling image) of the quality of produced images. Transfer performance was evaluated by using an image forming apparatus (manufactured by Ricoh Co., Ltd.) with a run length of 5,000 sheets. Thereafter, a solid black image was passed through the image forming apparatus to scale the transfer performance of the image visually. In addition, background fouling was evaluated by using an image forming apparatus (manufactured by Ricoh Co., Ltd.) with a run length of 5,000 sheets.

Thereafter, the image forming apparatus was suspended during printing of a white sheet image and the development agent on the image bearing member after development was transferred by a Scotch tape (Sumitomo 3M). The difference between the tape and non-transferred tape was quantitatively evaluated by a spectrodensitometer (manufactured by X-Rite). The difference less than 0.30 was rated good and, 0.30 or greater, bad.

In combination of these two, both images having good quality were rated as G (Good), both images having not good but allowable quality were rated as F (Fair), and both images having not good quality were rated as B (Bad).

2. Image Granularity and Sharpness

Using a digital full color photocopying machine (imagio-Color 2800, manufactured by Ricoh Co., Ltd.), monochrome photographic images were printed and evaluated visually as to the level of granularity and sharpness.

From good to bad, the rating was:

E (Excellent) was on a par with offset printing

G (Good) was slightly inferior to offset printing

F (Fair) was significantly inferior to offset printing

B (Bad) was the same as conventional electrophotographic images (extremely bad).

3. Fixability Evaluation

Sheets (TYPE 6200 paper, manufactured by Ricoh Co., Ltd.) were set in a photocopier having a remodeled fixing device based on a photocopier (MF-2200, manufactured by Ricoh Co., Ltd.) having a TEFLON™ roller in the fixing device to conduct a photocopying test. The cold offset temperature (the lowest fixing temperature) was obtained by changing the fixing temperature. The lowest fixing temperature of conventional low temperature fixable toner was about 140° C. to 150° C. The evaluation conditions of the low temperature fixing were: the linear speed of sheet feeding was from 120 mm/s to 150 mm/s, the surface pressure was 1.2 kgf/cm2, and the nipping width was 3 mm. The evaluation conditions of high temperature offset were: the linear speed of sheet feeding was 50 mm/s, the surface pressure was 2.0 kgf/cm$^2$, and the nipping width was 4.5 mm.

The criteria for cold offset were as follows:

Cold offset (low temperature fixability, 5 rank rating)

E (Excellent): lower than 140° C.

G (Good): 140° C. to 149° C.

F (Fair): 150° C. to 159° C.

B (Bad): 160° C. to 169° C.

VB (Very bad): 170° C. or higher

4. Evaluation on High Temperature Stability

The toner was preserved at 55° C. for 8 hours and thereafter screened with a sieve having a 42 mesh for 2 minutes and the remaining ratio of the toner on the wire screen was determined as an indicator of the high temperature stability. The better the high temperature stability, the less the remaining ratio. High temperature stability was scaled at rthe following four levels.

B (Bad): 30% or higher

F (Fair): 20% to less than 30%

G (Good): 10% to less than 20%

E (Excellent): less than 10%

5. Total Evaluation

The total evaluation was made at 4 level scaling.

E (Excellent): Extremely good on image quality amelioration and competence of development agent for electrophotography G (good): Good on image quality amelioration and competence of development agent for electrophotography F (Fair): Trade-off between image quality amelioration and competence of development agent for electrophotography was not overcome B (Bad): Inferior to conventional art in terms of image quality amelioration and competence of development agent for electrophotography As shown in Table 1, each of the toner of the present disclosure in which the surface of a mother toner particle was covered with non-spherical (having an SF of 1.20 or greater) resin particles having an outer shell layer formed of silica or modified silica had good or excellent image quality, image granularity/sharpness, fixability, and high temperature stability and were at a tolerable level for practical use in the total evaluation.

To the contrary, the development agent in Comparative Example 1 in which the resin particle BA having a silica layer was attached to the surface of the mother toner particle A and the resin particle BA had a shape form (SF) was 1.10 had problems with regard to the image granularity and sharpness and the high temperature stability was 30% or more (rated as bad). Consequently, the development agent was at a level having a problem for practical use.

In addition, the development agent in Comparative Example 2 in which the surface of the mother toner particle was covered with PMMA particulate (MP-300, manufactured by Soken Chemical & Engineering Co., Ltd.) having no silica layer on its surface had problems with the image quality, the image granularity and sharpness, and the high temperature stability.

Consequently, the development agent was at a level having a problem for practical use.

Moreover, the development agent in Comparative Example 3 in which the surface of the mother toner particle was covered had problems with the image granularity and sharpness and the high temperature stability. Consequently, the development agent was at a level having a problem for practical use.

As seen in the results shown above, since the resin particle having a silica layer formed on its surface was deformed to be non-spherical when the particle was attached to the surface of the mother toner particle, unlike a typical external additive such as silica, the external additive (the resin particle having a silica layer) does not easily move on the surface of the mother toner particle or is not easily detached therefrom. Therefore, the surface is kept being covered.

For this reason, since the surface is kept being covered for an extended period of time, it has been found that a significant improvement is obtained with regard to the toner durability,

TABLE 1

| Example | Toner | External additive/ Shape factor (SF) External additive | SF | Image quality | Image granularity/ sharpness | Fixing | High temp. stability | Total |
|---|---|---|---|---|---|---|---|---|
| Example 1 | X1 | Resin particulate AA | 1.23 | G | G | G | G | G |
| Example 2 | X2 | Resin particulate AB | 1.41 | G | E | G | E | E |
| Example 3 | X3 | Resin particulate BB | 1.36 | G | G | F | G | G |
| Comparative Example 1 | Y1 | Resin particulate BA | 1.10 | G | F | F | B | B |
| Comparative Example 2 | Y2 | PMMA particulate | 1.43 | F | F | G | F | B |
| Comparative Example 3 | Y3 | Solgel method silica | 1.10 | G | F | G | F | F |

environmental characteristics, and hydrophobicity from the evaluation on quality using a printer available on the market.

The development agent of the present disclosure is either of a single component development agent or two component development agent and the toner of the present disclosure is contained in either case. Therefore, if images are formed using the development agent by electrophotography, quality images having both excellent cleanability and durability are formed.

Having now fully described embodiments of the present invention, it will be apparent to one of ordinary skill in the art that many changes and modifications can be made thereto without departing from the spirit and scope of embodiments of the invention as set forth herein.

What is claimed is:

1. Toner comprising:

a mother toner particle comprising:

a binder resin; and a coloring agent; and an external additive to cover the mother toner particle, wherein the external additive comprises a resin particle, wherein the resin particle has an outer shell layer comprising silica or modified silica, wherein an amount of the silica or the modified silica in the resin particle having the outer shell layer is from 2% by weight to 10% by weight based on a total amount of the resin particle having the outer shell layer, and wherein the resin particle having the outer shell layer has a non-spherical form with a shape factor of 1.20 or greater as calculated by formula:

$$\text{Shape factor}=[(\text{Absolute maximum length of particle})^2/(\text{Projected area of particle})]\times(\pi/4).$$

2. The toner according to claim 1, wherein the resin particle has a primary particle diameter of from 25 nm to 200 nm.

3. The toner according to claim 1, wherein the resin particle comprises a resin comprising at least one of a non-cross-linked acrylic resin, a cross-linked acrylic resin, a non-cross-linked polyethylene resin, and a cross-linked polystyrene resin.

4. The toner according to claim 1, wherein the external additive further comprises a hydrophobic inorganic particulate.

5. The toner according to claim 1, wherein the silica or the modified silica is formed by reaction of a silane derivative, wherein the silane derivative is a reactive silicon compound selected from a substituted or non-substituted alkoxy silane compound, a substituted or non-substituted halogenated silane compound, and a silicate.

6. The toner according to claim 1, wherein the binder resin comprises a resin material that comprises at least one of a non-modified polyester comprising only an ester bonding unit, a modified polyester comprising an ester bonding and a bonding unit other than the ester bonding, and a crystalline polyester.

* * * * *